US005941770A

United States Patent [19]

Miers et al.

[11] Patent Number: 5,941,770

[45] Date of Patent: Aug. 24, 1999

[54] COMPUTER GAMING SYSTEM

[75] Inventors: Darrell Miers; Robert Reitzen, both of Los Angeles; Bill Rommerdahl, Huntingdon Beach; Michael Hesse, Westlake Village; Hein Hundal, Encino, all of Calif.

[73] Assignee: Gamecraft, Inc., Huntington Beach, Calif.

[21] Appl. No.: 08/851,255

[22] Filed: May 5, 1997

[51] Int. Cl.[6] ..... A63F 7/06

[52] U.S. Cl. ..... 463/13; 463/26; 273/292

[58] Field of Search ..... 463/1, 11, 12–13, 463/16, 20, 25, 29–30, 36–37, 40–42; 364/410.1, 412.1

[56] References Cited

U.S. PATENT DOCUMENTS

| | | | |
|---|---|---|---|
| 1,461,633 | 7/1923 | Stansbury . | |
| 2,223,175 | 11/1940 | Ink . | |
| 3,033,572 | 5/1962 | Thibault . | |
| 4,380,334 | 4/1983 | Minkoff et al. . | |
| 4,614,342 | 9/1986 | Takashima . | |
| 4,657,256 | 4/1987 | Okada . | |
| 4,679,143 | 7/1987 | Hagiwara . | |
| 4,760,527 | 7/1988 | Sidley . | |
| 4,799,683 | 1/1989 | Bruner, Jr. . | |
| 4,838,552 | 6/1989 | Hagiwara . | |
| 4,861,041 | 8/1989 | Jones et al. | 463/27 |
| 4,926,327 | 5/1990 | Sidley . | |
| 5,033,744 | 7/1991 | Bridgeman et al. . | |
| 5,046,736 | 9/1991 | Bridgeman et al. . | |
| 5,221,083 | 6/1993 | Dote . | |
| 5,224,706 | 7/1993 | Bridgeman et al. . | |
| 5,255,915 | 10/1993 | Miller . | |
| 5,308,065 | 5/1994 | Bridgeman et al. . | |
| 5,356,140 | 10/1994 | Dabrowski et al. . | |
| 5,377,973 | 1/1995 | Jones et al. . | |
| 5,531,440 | 7/1996 | Dabrowski et al. . | |
| 5,531,441 | 7/1996 | Dabrowski et al. . | |
| 5,575,717 | 11/1996 | Houriet, Jr. et al. . | |

OTHER PUBLICATIONS

SWFTE International Ltd's Playing Bicycle Poker, by Wesley Steiner, 9 pages, Jan. 22, 1994.

Hoyle's Simplified Guide to the Popular Card Games, by Walter Gibson, pp. 108–123, Copyright 1963.

Scarne's Encyclopedia of Games, by John Scarne, Chapter 2, Draw Poker, pp. 6–32, Copyright 1973.

*Primary Examiner*—Jessica J. Harrison
*Assistant Examiner*—Mark A. Sager
*Attorney, Agent, or Firm*—Hecker & Harriman

[57] ABSTRACT

The present invention comprises an intelligent gaming system that includes a game engine, simulation engine, and, in certain embodiments, a static evaluator. Embodiments of the invention include an intelligent, poker playing slot machine that allows a user to play poker for money against one or more intelligent, simulated opponents. The simulation engine generates actions for the simulated player(s). The simulation engine allows a real person, or user, to play against intelligent, simulated opponents. In addition, in certain embodiments a static evaluator offers another level of play in which the user can play against a predetermined criteria for winning. In one embodiment of the invention, the user plays against simulated opponent(s). In another embodiment of the invention, the user plays against simulated opponent(s) and against the predetermined criteria.

47 Claims, 27 Drawing Sheets

| | 720 P1A1 | 722 P2A1 | 724 P1A2 | 726 P2A2 | 728 P1A3 |
|---|---|---|---|---|---|
| 700A | Fold | | | | |
| 700B | Bet | | | | |
| 702A | Bet | Fold | | | |
| 702B | Bet | Call | | | |
| 702C | Bet | Raise | | | |
| 704A | Bet | Raise | Fold | | |
| 704B | Bet | Raise | Call | | |
| 704C | Bet | Raise | Raise | | |
| 706A | Bet | Raise | Raise | Fold | |
| 706B | Bet | Raise | Raise | Call | |
| 706C | Bet | Raise | Raise | Raise | |
| 708A | Bet | Raise | Raise | Raise | Fold |
| 708B | Bet | Raise | Raise | Raise | Call |
| 708C | Bet | Raise | Raise | Raise | Raise |

FIGURE 7A

| | 720 P1A1 | 722 P2A1 | 724 P1A2 | 726 P2A2 | 728 P1A3 |
|---|---|---|---|---|---|
| 700A | Fold | | | | |
| 700B | Bet | | | | |
| 702A | Bet | Fold | | | |
| 702B | Bet | Call | | | |
| 702C | Bet | Raise | | | |
| 714A | Bet | Raise | Fold | | |
| 714B | Bet | Raise | Call | | |

FIGURE 7B

| | 1020 P1A1 | 1022 P2A1 | 1024 P1A2 | 1026 P2A2 | 1028 P1A3 |
|---|---|---|---|---|---|
| 1000A | Check | | | | |
| 1000B | Bet | | | | |
| 1002A | Check | Check | | | |
| 1002B | Check | Bet | | | |
| 1004A | Bet | Fold | | | |
| 1004B | Bet | Call | | | |
| 1004C | Bet | Raise | | | |
| 1006A | Bet/Check | Raise/Bet | Fold | | |
| 1006B | Bet/Check | Raise/Bet | Call | | |
| 1006C | Bet/Check | Raise/Bet | Raise | | |
| 1008A | Bet/Check | Raise/Bet | Raise | Fold | |
| 1008B | Bet/Check | Raise/Bet | Raise | Call | |
| 1008C | Bet/Check | Raise/Bet | Raise | Raise | |
| 1010A | Bet/Check | Raise/Bet | Raise | Raise | Fold |
| 1010B | Bet/Check | Raise/Bet | Raise | Raise | Call |
| 1010C | Bet/Check | Raise/Bet | Raise | Raise | Raise |

*FIGURE 10*

| | 1120 P1A1 | 1122 P2A1 | 1124 P1A2 | 1126 P2A2 | 1128 P1A3 |
|---|---|---|---|---|---|
| 1100A | Check | | | | |
| 1100B | Bet | | | | |
| 1102A | Check | Check | | | |
| 1102B | Check | Bet | | | |
| 1104A | Check | Bet | Fold | | |
| 1104B | Check | Bet | Call | | |
| 1106A | Bet | Fold | | | |
| 1106B | Bet | Call | | | |
| 1106C | Bet | Raise | | | |
| 1108A | Bet | Raise | Fold | | |
| 1108B | Bet | Raise | Call | | |
| 1108C | Bet | Raise | Raise | | |
| 1110A | Bet | Raise | Raise | Fold | |
| 1110B | Bet | Raise | Raise | Call | |

*FIGURE 11*

1200

Action Sequence Triggering Variables

| Game Situation | | 1381 | 1382 B1 | 1383 b1 | 1384 C2 | 1385 C1R | 1386 R2 | 1387 r2 | 1388 C2RR | 1389 RR1 | 1390 rr1 | 1391 C1 | 1392 B2 | 1393 b2 |
|---|---|---|---|---|---|---|---|---|---|---|---|---|---|---|
| 1396 Pot Size A | 1301 | 1.0000 | 5.1231 | 0.1315 | 4.0659 | 5.1364 | 6.1068 | 0.1091 | 6.1146 | 6.1352 | 0.0952 | 4.0659 | 4.1141 | 0.1410 |
| | 1302 | 1.0000 | 4.0501 | 0.1499 | 1.0627 | 4.0868 | 5.1381 | 0.0776 | 5.1405 | 5.1465 | 0.1119 | 0.1499 | 1.1235 | 0.1080 |
| | 1303 | 1.0000 | 1.0678 | 0.1499 | 1.0397 | 4.0849 | 5.1332 | 0.1393 | 6.0348 | 6.0971 | 0.1064 | 1.0397 | 1.0537 | 1.0303 |
| | 1304 | 1.0000 | | | | | | | | | | | | |
| | . . . | | | | | | | | | | | | | |
| | 1336 | 1.0000 | | | | | | | | | | | | |
| 1398 Pot Size B | 1337 | 1.0000 | 5.0845 | 0.1340 | 4.0591 | 5.1236 | 6.0896 | 0.1129 | 6.1007 | 6.1311 | 0.1003 | 4.0591 | 4.1048 | 0.1423 |
| | 1338 | 1.0000 | | | | | | | | | | | | |
| | 1339 | 1.0000 | | | | | | | | | | | | |
| | 1340 | 1.0000 | | | | | | | | | | | | |
| | . . . | | | | | | | | | | | | | |
| | 1372 | 1.0000 | | | | | | | | | | | | |

FIGURE 13

| | | B1 | b1 | C2 | C1R | R2 | r2 | C2RR | RR1 | rr1 | C1 | B2 | b2 |
|---|---|---|---|---|---|---|---|---|---|---|---|---|---|
| 1301 | 1.0000 | 5.1231 | 0.1315 | 4.0659 | 5.1364 | 6.1068 | 0.1091 | 6.1146 | 6.1352 | 0.0952 | 4.0659 | 4.1141 | 0.1410 |
| 1302 | 1.0000 | 4.0501 | 0.1499 | 1.0627 | 4.0868 | 5.1381 | 0.0776 | 5.1405 | 5.1465 | 0.1119 | 0.1499 | 1.1235 | 0.1080 |
| 1303 | 1.0000 | 1.0678 | 0.1499 | 1.0397 | 4.0849 | 5.1332 | 0.1393 | 6.0348 | 6.0971 | 0.1064 | 1.0397 | 1.0537 | 1.0303 |
| 1304 | 1.0000 | 1.0664 | 0.1499 | 1.0396 | 4.0850 | 5.1336 | 0.1401 | 6.0346 | 6.0932 | 0.1070 | 1.0396 | 1.0530 | 1.0307 |
| 1305 | 1.0000 | 4.0501 | 0.1499 | 1.0470 | 4.0859 | 5.1358 | 0.1400 | 5.1423 | 6.0321 | 0.1101 | 0.1499 | 1.0920 | 0.1418 |
| 1306 | 1.0000 | 4.0501 | 0.1499 | 1.0377 | 4.0845 | 5.1320 | 0.0705 | 5.1390 | 6.1080 | 0.1046 | 0.1499 | 1.0653 | 0.1179 |
| 1307 | 1.0000 | 8.1400 | 0.0300 | 4.0616 | 8.1400 | 8.1400 | 0.0300 | 8.1400 | 8.1400 | 0.0300 | 2.1047 | 3.0215 | 0.1499 |
| 1308 | 1.0000 | 2.0904 | 0.1464 | 1.0529 | 2.1195 | 3.0718 | 0.0910 | 4.0730 | 5.1323 | 0.0968 | 1.0510 | 1.1492 | 0.1051 |
| 1309 | 1.0000 | 1.0725 | 1.0295 | 1.0406 | 2.1010 | 3.0653 | 0.1405 | 3.0892 | 3.1085 | 0.1076 | 1.0403 | 1.0564 | 0.1499 |
| 1310 | 1.0000 | 1.0697 | 1.0303 | 1.0401 | 2.1006 | 3.0653 | 0.1405 | 3.0912 | 3.1073 | 0.1078 | 1.0401 | 1.0549 | 1.0302 |
| 1311 | 1.0000 | 1.1339 | 0.1492 | 1.0360 | 2.1079 | 3.0615 | 0.1401 | 3.1059 | 3.1459 | 0.1022 | 1.0441 | 1.0890 | 0.1419 |
| 1312 | 1.0000 | 1.1004 | 1.0209 | 1.0410 | 2.1036 | 3.0588 | 0.0824 | 3.0761 | 3.1364 | 0.1035 | 1.0420 | 1.0712 | 0.1169 |
| 1313 | 1.0000 | 8.1400 | 0.0300 | 4.0616 | 8.1400 | 8.1400 | 0.0300 | 8.1400 | 8.1400 | 0.0300 | 1.1129 | 3.0357 | 0.1499 |
| 1314 | 1.0000 | 2.1423 | 0.1421 | 0.1495 | 3.0459 | 3.1150 | 0.0909 | 4.0764 | 5.1326 | 0.1113 | 0.1497 | 1.1183 | 0.1088 |
| 1315 | 1.0000 | 1.0624 | 0.1475 | 1.0404 | 1.1039 | 3.0574 | 0.1406 | 3.0650 | 3.1062 | 0.1277 | 1.0335 | 1.0566 | 0.1499 |
| 1316 | 1.0000 | 1.0611 | 0.1475 | 1.0402 | 1.1024 | 3.0571 | 0.1406 | 3.0622 | 3.1050 | 0.1280 | 1.0423 | 1.0553 | 1.0301 |
| 1317 | 1.0000 | 1.0715 | 0.1471 | 0.1488 | 1.1100 | 3.0421 | 0.1401 | 3.0886 | 3.1455 | 0.1147 | 0.1485 | 1.0533 | 0.1422 |
| 1318 | 1.0000 | 1.0727 | 0.1470 | 1.0248 | 1.1117 | 3.0505 | 0.0828 | 3.0688 | 3.1327 | 0.1210 | 0.1485 | 1.0584 | 0.1190 |
| 1319 | 1.0000 | 8.1400 | 0.0300 | 4.0616 | 8.1400 | 8.1400 | 0.0300 | 8.1400 | 8.1400 | 0.0300 | 1.0737 | 1.1372 | 0.1499 |
| 1320 | 1.0000 | 2.1266 | 0.1411 | 0.1486 | 2.1406 | 3.0859 | 0.0910 | 4.0741 | 5.1324 | 0.1306 | 1.0386 | 1.1121 | 0.1096 |
| 1321 | 1.0000 | 1.1045 | 0.1467 | 1.0420 | 1.1227 | 2.1073 | 0.1418 | 2.1247 | 3.0503 | 0.1349 | 1.0388 | 1.0737 | 0.1486 |
| 1322 | 1.0000 | 1.0973 | 0.1472 | 1.0420 | 1.1179 | 2.0965 | 0.1421 | 2.1077 | 3.0423 | 0.1352 | 1.0372 | 1.0694 | 0.1488 |
| 1323 | 1.0000 | 1.1004 | 0.1469 | 0.1490 | 1.1205 | 2.1080 | 0.1403 | 2.1412 | 2.1490 | 0.1361 | 1.0325 | 1.0690 | 0.1421 |
| 1324 | 1.0000 | 1.0989 | 0.1470 | 1.0287 | 1.1193 | 2.1033 | 0.0918 | 2.1182 | 3.0252 | 0.1358 | 1.0324 | 1.0681 | 0.1174 |
| 1325 | 1.0000 | 8.1400 | 0.0300 | 4.0616 | 8.1400 | 8.1400 | 0.0300 | 8.1400 | 8.1400 | 0.0300 | 1.0800 | 1.1439 | 0.1499 |
| 1326 | 1.0000 | 3.1451 | 0.1401 | 0.1466 | 3.1467 | 5.1110 | 0.0845 | 5.1222 | 5.1413 | 0.1400 | 0.1451 | 1.0812 | 0.1124 |
| 1327 | 1.0000 | 1.1425 | 0.1411 | 1.0426 | 1.1447 | 2.0738 | 0.1423 | 2.0997 | 3.0402 | 0.1401 | 1.0212 | 1.0912 | 0.1481 |
| 1328 | 1.0000 | 1.1424 | 0.1411 | 1.0426 | 1.1446 | 2.0478 | 0.1427 | 2.0806 | 3.0315 | 0.1401 | 1.0230 | 1.0913 | 0.1482 |
| 1329 | 1.0000 | 1.1119 | 0.1416 | 0.1455 | 1.1402 | 1.1482 | 0.1404 | 1.1490 | 2.1452 | 0.1401 | 0.1455 | 0.1496 | 0.1427 |
| 1330 | 1.0000 | 1.1443 | 0.1409 | 0.1457 | 1.1461 | 2.1410 | 0.0868 | 2.1457 | 3.0947 | 0.1401 | 0.1448 | 1.0364 | 0.1216 |
| 1331 | 1.0000 | 8.1400 | 0.0300 | 4.0616 | 8.1400 | 8.1400 | 0.0300 | 8.1400 | 8.1400 | 0.0300 | 1.0579 | 1.1156 | 0.1499 |
| 1332 | 1.0000 | 1.1336 | 0.1039 | 0.1356 | 1.1404 | 2.1230 | 0.0947 | 2.1394 | 5.1210 | 0.0701 | 0.1374 | 1.0421 | 0.1157 |
| 1333 | 1.0000 | 1.1193 | 0.1082 | 1.0421 | 1.1293 | 2.1052 | 0.1419 | 2.1210 | 3.0492 | 0.0811 | 1.0383 | 1.0788 | 0.1485 |
| 1334 | 1.0000 | 1.1149 | 0.1095 | 1.0421 | 1.1257 | 2.0920 | 0.1422 | 2.1052 | 3.0408 | 0.0814 | 1.0379 | 1.0764 | 0.1487 |
| 1335 | 1.0000 | 1.0768 | 0.1160 | 0.1457 | 1.0959 | 1.1436 | 0.1407 | 1.1449 | 1.1496 | 0.0911 | 0.1467 | 1.0385 | 0.1424 |
| 1336 | 1.0000 | 1.0751 | 0.1163 | 0.1369 | 1.0934 | 1.1391 | 0.0977 | 1.1434 | 2.1281 | 0.0865 | 0.1369 | 0.1486 | 0.1241 |

FIGURE 16A

| | | B1 | b1 | C2 | C1R | R2 | r2 | C2RR | RR1 | rr1 | C1 | B2 | b2 |
|---|---|---|---|---|---|---|---|---|---|---|---|---|---|
| 1337 | 1.0000 | 5.0845 | 0.1340 | 4.0591 | 5.1236 | 6.0896 | 0.1129 | 6.1007 | 6.1311 | 0.1003 | 4.0591 | 4.1048 | 0.1423 |
| 1338 | 1.0000 | 4.0501 | 0.1499 | 2.0375 | 4.0769 | 5.1322 | 0.1070 | 5.1397 | 6.0736 | 0.1113 | 0.1499 | 2.1139 | 0.1419 |
| 1339 | 1.0000 | 1.1028 | 0.1499 | 1.0693 | 4.0752 | 5.1244 | 0.1083 | 6.0586 | 6.1243 | 0.1026 | 1.0680 | 1.0854 | 1.0611 |
| 1340 | 1.0000 | 1.1024 | 0.1499 | 1.0700 | 4.0752 | 5.1245 | 0.1080 | 6.0617 | 6.1240 | 0.1027 | 1.0687 | 1.0856 | 1.0620 |
| 1341 | 1.0000 | 4.0501 | 0.1499 | 1.0315 | 4.0772 | 5.1331 | 0.1400 | 5.1418 | 6.0269 | 0.1121 | 0.1499 | 1.0658 | 0.1414 |
| 1342 | 1.0000 | 4.0501 | 0.1499 | 1.0280 | 4.0762 | 5.1298 | 0.0696 | 5.1358 | 6.1022 | 0.1084 | 0.1499 | 1.0493 | 0.1137 |
| 1343 | 1.0000 | 8.1400 | 0.0300 | 4.0551 | 8.1400 | 8.1400 | 0.0300 | 8.1400 | 8.1400 | 0.0300 | 2.0906 | 2.1465 | 0.1499 |
| 1344 | 1.0000 | 2.1423 | 0.1335 | 1.0905 | 2.1480 | 3.1335 | 0.1125 | 3.1428 | 6.0243 | 0.1001 | 1.0905 | 2.1144 | 0.1418 |
| 1345 | 1.0000 | 1.1472 | 0.1470 | 1.0711 | 2.1013 | 3.0524 | 0.1283 | 3.0705 | 3.1216 | 0.1113 | 1.0514 | 1.0993 | 1.0319 |
| 1346 | 1.0000 | 1.1259 | 0.1474 | 1.0715 | 2.0989 | 3.0491 | 0.1278 | 3.0709 | 3.1219 | 0.1112 | 1.0710 | 1.0985 | 1.0600 |
| 1347 | 1.0000 | 1.0726 | 0.1482 | 0.1490 | 2.0911 | 3.0308 | 0.1401 | 3.0711 | 3.1451 | 0.1077 | 0.1493 | 1.0425 | 0.1416 |
| 1348 | 1.0000 | 1.0802 | 0.1481 | 0.1499 | 2.0929 | 3.0403 | 0.0815 | 3.0560 | 3.1263 | 0.1108 | 0.1493 | 1.0464 | 0.1140 |
| 1349 | 1.0000 | 8.1400 | 0.0300 | 4.0551 | 8.1400 | 8.1400 | 0.0300 | 8.1400 | 8.1400 | 0.0300 | 1.0901 | 2.1480 | 0.1499 |
| 1350 | 1.0000 | 6.1328 | 0.1056 | 1.0572 | 6.1452 | 7.0921 | 0.0784 | 7.0984 | 7.1269 | 0.0866 | 1.0692 | 2.0906 | 0.1449 |
| 1351 | 1.0000 | 1.1222 | 0.1424 | 1.0707 | 1.1373 | 3.0817 | 0.1252 | 3.0889 | 3.1301 | 0.1195 | 1.0703 | 1.0949 | 1.0472 |
| 1352 | 1.0000 | 1.1208 | 0.1425 | 1.0711 | 1.1362 | 3.0806 | 0.1250 | 3.0878 | 3.1297 | 0.1197 | 1.0715 | 1.0947 | 1.0605 |
| 1353 | 1.0000 | 1.0461 | 0.1444 | 0.1454 | 1.0853 | 3.0244 | 0.1401 | 3.0640 | 3.1449 | 0.1127 | 0.1454 | 0.1479 | 0.1421 |
| 1354 | 1.0000 | 1.0806 | 0.1437 | 0.1457 | 1.1112 | 3.0516 | 0.0811 | 3.0661 | 3.1314 | 0.1189 | 0.1455 | 1.0249 | 0.1164 |
| 1355 | 1.0000 | 8.1400 | 0.0300 | 4.0551 | 8.1400 | 8.1400 | 0.0300 | 8.1400 | 8.1400 | 0.0300 | 1.0515 | 1.1300 | 0.1499 |
| 1356 | 1.0000 | 8.1400 | 0.0300 | 1.0561 | 8.1400 | 8.1400 | 0.0300 | 8.1400 | 8.1400 | 0.0300 | 1.0442 | 1.1267 | 0.1474 |
| 1357 | 1.0000 | 1.1444 | 0.1429 | 1.0712 | 1.1490 | 2.1481 | 0.1292 | 3.0641 | 3.1191 | 0.1402 | 1.0482 | 1.1009 | 1.0280 |
| 1358 | 1.0000 | 1.1390 | 0.1433 | 1.0718 | 1.1447 | 2.1422 | 0.1302 | 2.1469 | 3.1145 | 0.1402 | 1.0638 | 1.1039 | 1.0481 |
| 1359 | 1.0000 | 1.0692 | 0.1468 | 0.1480 | 1.0905 | 1.1492 | 0.1402 | 1.1497 | 2.1468 | 0.1407 | 0.1497 | 1.0438 | 0.1416 |
| 1360 | 1.0000 | 1.0822 | 0.1462 | 0.1488 | 1.1010 | 2.0746 | 0.0907 | 2.0995 | 2.1461 | 0.1407 | 0.1498 | 1.0501 | 0.1136 |
| 1361 | 1.0000 | 8.1400 | 0.0300 | 4.0551 | 8.1400 | 8.1400 | 0.0300 | 8.1400 | 8.1400 | 0.0300 | 1.0588 | 1.1427 | 0.1499 |
| 1362 | 1.0000 | 8.1400 | 0.0300 | 1.0561 | 8.1400 | 8.1400 | 0.0300 | 8.1400 | 8.1400 | 0.0300 | 0.1494 | 1.1372 | 0.1472 |
| 1363 | 1.0000 | 1.1442 | 0.1406 | 1.0716 | 1.1456 | 2.1387 | 0.1309 | 2.1442 | 3.1107 | 0.1400 | 1.0403 | 1.1090 | 0.1497 |
| 1364 | 1.0000 | 1.1439 | 0.1406 | 1.0724 | 1.1453 | 2.1266 | 0.1321 | 2.1335 | 3.0879 | 0.1400 | 1.0487 | 1.1117 | 1.0241 |
| 1365 | 1.0000 | 1.0735 | 0.1413 | 0.1438 | 1.1011 | 1.1465 | 0.1404 | 1.1473 | 2.1415 | 0.1401 | 0.1438 | 0.1480 | 0.1421 |
| 1366 | 1.0000 | 1.1435 | 0.1407 | 0.1433 | 1.1450 | 2.1186 | 0.0879 | 2.1266 | 3.0429 | 0.1401 | 0.1433 | 0.1498 | 0.1171 |
| 1367 | 1.0000 | 8.1400 | 0.0300 | 4.0551 | 8.1400 | 8.1400 | 0.0300 | 8.1400 | 8.1400 | 0.0300 | 1.0452 | 1.1092 | 0.1499 |
| 1368 | 1.0000 | 8.1400 | 0.0300 | 1.0561 | 8.1400 | 8.1400 | 0.0300 | 8.1400 | 8.1400 | 0.0300 | 1.0343 | 1.1038 | 0.1477 |
| 1369 | 1.0000 | 1.1492 | 0.0937 | 1.0711 | 2.0932 | 2.1498 | 0.1287 | 3.0680 | 3.1206 | 0.0744 | 1.0503 | 1.0997 | 1.0307 |
| 1370 | 1.0000 | 1.1435 | 0.0959 | 1.0718 | 1.1477 | 2.1423 | 0.1302 | 2.1470 | 3.1146 | 0.0749 | 1.0641 | 1.1038 | 1.0483 |
| 1371 | 1.0000 | 1.0557 | 0.1130 | 0.1441 | 1.0730 | 1.1336 | 0.1407 | 1.1408 | 1.1476 | 0.0902 | 0.1441 | 1.0203 | 0.1417 |
| 1372 | 1.0000 | 1.0514 | 0.1135 | 0.1304 | 1.0687 | 1.1291 | 0.0972 | 1.1335 | 2.1007 | 0.0871 | 0.1304 | 0.1444 | 0.1204 |

FIGURE 16B

COMPUTER GAMING SYSTEM

BACKGROUND OF THE INVENTION

1. Field of the Invention

This invention relates to an intelligent card playing gaming system.

2. Background Art

Existing electronic casino games (slot machines) are available in which one player plays against a predetermined criteria that determines whether the player wins. One such game that is prominent in a casino or other gaming environment is referred to as video poker. In video poker, the player is dealt a hand of cards which is evaluated against a payoff table. Thus, the player is pitted against static, predetermined hand rankings. If the player's hand exceeds a threshold ranking, the player wins the amount indicated for the threshold. The player does not play poker against another player.

In Bridgeman et al, U.S. Pat. No. 5,046,736, a multiplayer poker slot machine is described. One player is a person and the other player(s) is simulated by the slot machine system. The real player initiates all of the actions in the game while the simulated player merely responds by imitating each action of the player. There is no ability or intelligence of the simulated player to develop a strategy in which the simulated player decides upon an action other than the one performed by the real player. It is therefore, impossible for the simulated player to be the initiator of the game (i.e., make the first move). Further, the real player can predict with 100% accuracy the moves that the simulated player will take thereby making it easier for the real player to out maneuver the simulated player.

The following provides a discussion of the game of poker.

Poker Basics

There are a large number of poker variations. However, certain basic concepts apply to most types of poker.

Poker hands generally consist of five cards from a 52 card deck. There are 2,598,960 different hands. The hands are linearly ordered in strength or "rank." There are nine general categories of hands, ranked as shown in Table 1.

TABLE 1

Ranking by Categories

| Rank | Name | Example |
|---|---|---|
| 1 | Straight flush | J♣ 10♣ 9♣ 8♣ 7♣ |
| 2 | Four of a kind | K♣ K♦ K♥ K♠ 9♣ |
| 3 | Full house | J♦ J♥ J♠ 3♣ 3♥ |
| 4 | Flush | A♣ 10♣ 9♣ 5♣ 2♣ |
| 5 | Straight | 6♦ 5♥ 4♠ 3♣ 2♥ |
| 6 | Three of a kind | 10♠ 10♣ 10♦ 9♥ 7♣ |
| 7 | Two pair | A♥ A♠ 4♣ 4♦ 9♣ |
| 8 | One pair | 9♦ 9♥ K♠ 8♣ 6♥ |
| 9 | No pair | 3♣ 5♦ 6♥ J♠ Q♣ |

Within each category, hands are ranked according to the rank of individual cards, with an ace being the highest card and a 2 being the lowest card. There is no difference in rank between the four suits of cards. Table 2 shows the ranking of some example hands within the two pair category. Because the suits of the individual cards do not matter for two pair hands (the suits become relevant only for flushes and straight flushes, since all cards in these hands must be of the same suit), no suits are shown in Table 2.

Table 2

Relative Ranking of Some Two Pair Hands

| | |
|---|---|
| Highest | AAKKQ |
| | AAKKJ |
| | AAKK10 |
| | AAKK9 |
| | *** |
| | AAQQ2 |
| | AAJJK |
| | AAJJQ |
| | *** |
| | JJ223 |
| | 101099A |
| | 101099K |
| | *** |
| | 33226 |
| | 33225 |
| Lowest | 33224 |

All hands can be ranked in a linear ranking from highest to lowest. Because suits are all of the same value, however, there are multiple hands that have identical rankings. For example, there are four equivalent hands for each type of straight flush, four of a kind, or flush; there are over a hundred equivalent hands for each two pair variation, and there are over 1000 equivalent hands for each type of no-pair hand. Accordingly, although there are over 2,000,000 possible hands, there are significantly fewer possible rankings.

Poker is characterized by rounds of card dealing and betting. Numerous variations of poker exist, including "five card draw," "five card stud," "seven card stud," "hold'em," and "Omaha." The variations generally differ in the manner in which cards are dealt and in the manner in which bets are placed. Various criteria may also be used to determine the winning hand, including highest ranking hand wins, lowest ranking hand wins ("low-ball"), and high and low hands each win half ("high-low").

Typically, a game starts when each player has placed an initial bet, called the "ante," into the "pot." The term "pot" refers to the total accumulation of bets made during a game. Each player that has "anted" is dealt an initial set of cards. The number of cards depends on the particular variation of poker being played. In five card draw, each player is initially dealt five cards.

After the deal, the players have the opportunity to place bets. If a player places a bet, that bet must be matched ("called") or "raised" by each player that wants to remain in the game. A player who does not match a bet drops out of the game or "folds." A round of betting ends when either every player but one has folded, or when the highest bet or raise has been called by each remaining player such that each remaining player has paid the same amount into the pot during the round.

Each game may have several "rounds" of betting. If two or more players remain after a round of betting, either more cards are dealt, or there is a "showdown," depending on the game variation being played. A "showdown" occurs when two or more players remain in a game after the last round of betting for a game has been completed. A player wins a game of poker (also sometimes called a "hand of poker") either by having the highest ranking hand when a "showdown" occurs, or by being the last remaining player in the game after all other players have dropped out, or "folded." At a showdown, each player displays the player's hand to the other players. The player showing the hand with the highest ranking wins the pot.

FIG. 1 illustrates the sequence of events that occur in a game of five card draw poker. As shown in FIG. 1, the game begins with each player paying an ante into the pot at step 100. At step 105, each player is dealt five cards by one of the players who is referred to as the dealer. Players take turns being the dealer.

After each player has been dealt the initial set of five cards, the first round of betting occurs at step 110. In a round of betting, each player is successively given the opportunity to either "pass" (i.e. to place no bet, allowed only if no one has previously placed a bet during the round), to "call" (i.e. to pay an amount into the pot equal to the total amount paid by the immediately preceding bettor), to "raise" (i.e. to pay an amount into the pot greater than the amount paid by the immediately preceding bettor), or to "fold" (i.e. to not pay anything into the pot and thereby to drop out of the game). The betting sequence typically starts with the player to the immediate left of the dealer, and then progresses in a clockwise direction.

FIG. 2 illustrates an example of a first round of betting that may occur at step 110 of FIG. 1. In the example of FIG. 2 there are three players: player A 200, player B 205, and player C 210. Player A is the dealer. In FIG. 2, the cards dealt to each player are shown under the player's name. Thus, after the deal, player A's hand is AA762, player B's hand is KK225, and player C's hand is JJ843.

Since player B is the player to the immediate left of the dealer (player A), player B opens the betting round. Player B may pass (bet nothing), or place a bet. Player B's hand contains two pairs, which player B considers to be a good first round hand. Accordingly, as shown in FIG. 2, player B bets one "bet" at step 215. In this example, betting "one bet" means that the bettor bets the maximum betting limit allowed by the rules of the particular variation of poker game being played. Two types of betting are "limit" betting and "pot limit" betting. In limit betting, the maximum betting limit is a predetermined amount. For example, a betting limit may be $2. In pot limit betting, the maximum amount that a player may bet is the total amount in the pot at the time the bet is made, including the amount, if any, that the bettor would need to put into the pot if the bettor were calling. Other types of betting are no limit betting, and spread limit betting, in which bets are allowed within a certain range (e.g. $2–$8).

After player B has bet, it is player C's turn to act. Since player B has bet one bet, player C's choices are to match player B's bet ("call"), to raise, or to fold. Player C has a pair of jacks, which player C considers to be good enough to call but not good enough to raise. Accordingly, as shown in FIG. 2, player C calls at step 220 by placing an amount equal to player B's bet into the pot.

After player C has bet, it's player A's turn. Player A has a pair of aces, which player A considers to be good enough for not just calling, but raising. Player A therefore decides to raise player B's bet by one bet at step 225. Player A thus places a total of two bets into the pot—one to meet B's bet, and one to raise by one bet.

After player A raises one bet, the betting proceeds back to player B. Player B considers his two pair hand to be good enough to call player A's bet, but not good enough to reraise. Accordingly, player B calls at step 230 by putting one bet (the amount of player A's raise) into the pot so that the total amount bet by player B equals the total amount bet by player A.

After player B bets, the betting returns to player C. To stay in the game, player C must place one bet into the pot to match player A's raise. However, player C doesn't believe that player C's hand of two jacks is good enough to call player A's raise. Accordingly, player C decides to drop out of the game by folding at step 235.

After player C folds, there are no remaining uncalled raises or bets. Accordingly, the first round of betting ends at step 240. Thus, after the first round of betting, there are two remaining players, player A and player B.

The size of the pot in the example of FIG. 2 after the first round of betting depends on the size of the initial ante and the betting limit of the game. Table 3 illustrates the growth in the size of the pot during the round of betting illustrated in FIG. 2 for a betting limit of $1 and for a pot limit. In both cases, it is assumed that the total ante of all three players is $1.

Table 3

Size of Pot for Limit and Pot Limit Poker For Example of Figure 2

| Betting Step | Action | Resulting Pot ($1 Limit) | Resulting Pot (Pot Limit) |
|---|---|---|---|
| 0 | Ante | $1 | $1 |
| 1 | B bets 1 bet | $2 | $2 |
| 2 | C calls B's bet | $3 | $3 |
| 3 | A raises by 1 bet | $5 | $8 |
| 4 | B calls A's raise | $6 | $12 |
| 5 | C folds | $6 | $12 |

Thus, at the end of the first round of betting illustrated in FIG. 2, the resulting pot is $6 for $1 limit poker and $12 for pot limit poker.

Referring again to FIG. 1, at the end of the first round of betting at step 110, a determination is made as to whether more than one player is left in the game at step 115. If only one player is left, that player wins the pot at step 120. If more than one player is left, play continues to step 125.

At step 125, the players remaining in the game have the opportunity to discard cards from their hands and replace them with newly dealt cards. A player may discard and replace (or "draw") from 0 to 5 cards.

After the "draw" at step 125, the second round of betting takes place at step 130. The second round of betting proceeds in the same manner as the first round of betting. FIG. 3 illustrates an example of a second round of betting that occurs after the first round of betting of FIG. 2. As shown in FIG. 3, player A and player B each drew 1 card during the draw. Player A could have drawn more cards, but player A chose to draw only one card to make it appear that player A had a better hand than player A's pair of aces. Player A discarded the lowest card of player A's hand (a 2), and was dealt a 9. Player A's resulting hand as shown in FIG. 3 is AA976.

Player B, starting off with four good cards (two pairs), also drew one card, discarding a 5 and being dealt a 7. Player B's resulting hand as shown in FIG. 3 is KK227.

The betting in round 2, as in round 1, commences with player B. As shown in FIG. 3, even though player B has a fairly good two pair hand, player B chooses to "check" (i.e., "pass) at step 300. A check is equivalent to a pass, or to betting zero. The betting then proceeds to player A. Although player A's hand is not particularly strong, player A decides to bet 1 bet at step 305, hoping that player B will believe that player A has a strong hand and therefore fold. Making a bet with a weak hand that probably will not win in a showdown is referred to as "bluffing."

Player B does not fold, but instead raises player A by one bet at step 310. Player B thus pays two bets into the pot: one to meet player A's bet, and one to raise player A one bet. Player A, believing that player B's raise is a bluff, decides to reraise player B at step 315. Player A thus pays two more bets into the pot, one to match player B's raise and one for the reraise. Player B, not having bluffed, calls player A's reraise at step 320 by paying a bet into the pot to match player A's one bet reraise.

Player B's call of player A's reraise ends the second round of betting, leading to a showdown at step 325. The amount of money in the pot at the end of the second round of betting depends on whether the game is a limit game or a pot limit game. Table 4 shows the growth in the pot in the second round of betting for limit and pot limit games given the first round pot shown in table 3.

Table 4

Size of Pot for Limit and Pot Limit Poker For Example of Figure 3

| Betting Step | Action | Resulting Pot ($1 Limit) | Resulting Pot (Pot Limit) |
|---|---|---|---|
| 0 | Beginning pot | $6 | $12 |
| 1 | B checks | $6 | $12 |
| 2 | A bets 1 bet | $7 | $24 |
| 3 | B raises 1 bet | $9 | $72 |
| 4 | A reraises 1 bet | $11 | $216 |
| 5 | B calls | $12 | $324 |

As shown in Table 4, in a pot limit game, the size of the pot increases dramatically with each pot limit bet, while the increase of the pot in a limit game is more moderate.

Referring again to FIG. 1, after the second round of betting at step 130, a determination is made as to whether more than one player is left in the game at step 135. If only one player is left, the remaining player wins the pot at step 140. If more than one player remains in the game, there is a showdown at step 145. The remaining players shown their hands, and the highest ranking hand wins the pot at step 150. In the example of FIG. 3, player B's hand of two pairs has a higher ranking than player A's hand of a pair of aces. Accordingly, player A's bluffing strategy proves unsuccessful, and player B wins the pot.

SUMMARY OF THE INVENTION

The present invention comprises an intelligent gaming system that includes a game engine, simulation engine, and, in certain embodiments, a static evaluator. One embodiment of the invention comprises an intelligent, poker playing slot machine that allows a user to play poker for money against one or more intelligent, simulated opponents. Another embodiment comprises a computer game system that allows a player to play a game simultaneously against an intelligent, simulated opponent and against a set of predetermined criteria. The invention can be used, for example, with any of a variety of card games, including, without limitation, poker games including five card draw, five card stud, seven card stud, hold'em, Omaha, and others, in high-ball, low-ball, and high-low configurations, and with specified betting limits, pot limits, no-limits, spread limits, etc. The simulation engine generates actions for the simulated player(s). The simulation engine allows a real person, or user, to play against intelligent, simulated opponents. In addition, in certain embodiments a static evaluator offers another level of play in which the user can play against a predetermined criteria for winning. In one embodiment of the invention, the user plays against simulated opponent(s). In another embodiment of the invention, the user plays against simulated opponent(s) and against the predetermined criteria.

The game engine controls the play according to the rules established for the game. Input is received from either the player or a simulated player and is processed by the game engine. A game can be thought of as comprising a set of action points at which either the user or a simulated player are requested to act. The game engine restricts the players to valid actions at the action points.

The gaming system allows either the user or a simulated player to be the first to act. The user can respond to a request for an action when it is the user's turn to act. The simulation engine determines the action taken by a simulated player. The simulation engine uses its knowledge of the current state of the game to determine the action or sequence of actions to be taken by the simulated player. The current state of the game can include, for example, the simulation engine's understanding of the probability of winning. The current state of the game can further include the point of the game at which an action is to be taken.

In one embodiment of the invention, the gaming system is an intelligent poker playing slot machine system. The poker playing system is comprised of two poker players one of which is the simulated player and the other is the user. The poker playing system includes input means for accepting bets from the user and output means for paying winnings to the user. The poker playing system allows a first round of betting, a draw, and a second round of betting. The first round action(s) includes the number of cards that the simulated player draws at the conclusion of the first round.

A set of action sequence triggering variables having associated values are used by the simulation engine to identify the simulated player's action(s). Each action sequence triggering variable identifies one or more actions to be taken by the simulated player. An action sequence triggering variable is identified and its value is used to determine the action(s) that are adopted for use by the simulated player.

Each action sequence triggering variable used to determine a strategic sequence of actions for the simulated player is associated with a hand rank (e.g., three of a kind or a pair of queens). The hand rank of the hand dealt to the simulated player is compared to appropriate action sequence triggering variables to determine the action sequence strategy to be used. In one embodiment, a value is associated with each variable that identifies a portion of time that an action(s) associated with the variable is to be taken.

In the first round, one or more applicable action sequence triggering variable(s) are identified using the simulated player's hand rank. A determination is made whether the action(s) associated with the chosen action sequence triggering variables are to be adopted using the values associated with the variables. For example, in one embodiment, a random number between zero and one is compared to a value associated with a variable that represents a percentage of time an action(s) associated with the variable is to be taken. If the random number is less than the percentage, a first action is taken. If the random number is greater than the percentage, a different action is taken. For example, if the action sequence triggering variable(s) specifies that the simulated player is to bet at an action point where the simulated player can only bet or fold, the fold action can be adopted if it is determined using the variable values that the bet action should not be taken.

In the second round, values for a set of action sequence triggering variables are determined. In one embodiment, the values are retrieved from a lookup table. In another embodiment, the values are dynamically generated by the intelligent poker playing system. The values can be stored in an initialization table. Each row contains a set of values that are used to initialize the action sequence triggering variables. The selection or generation of the values for the set of action sequence triggering variables is based on a set of game criteria. For example, the game criteria can be the number of cards that P1 (the first player to act) and P2 (the second player to act) drew and the size of the pot.

If the values for the action sequence triggering variables are pre-calculated, the game criteria is used to identify a row in the initialization table. Each column in the row contains a value for one of the action sequence triggering variables. The values for each action sequence triggering variable specifies a hand rank and a percentage. Further, a set of actions is associated with each action sequence triggering variable. In one embodiment, the percentage represents the portion of time an action associated with the variable is to be adopted by the simulated player in the case where the player has the exact hand rank specified by the variable.

A variable's hand rank is used to position the variable relative to the other variables in the set of action sequence triggering variables along a hand strength axis. A hand strength is determined for the simulated player's hand and compared to the values of the action sequence triggering variables. The value of the simulated player's hand strength relative to the value of the action sequence triggering variables determines the simulated player's action(s).

In one embodiment, the gaming system of the invention allows the simultaneous play by a user against one or more intelligent, simulated opponents and against a predetermined payoff schedule. In one example, a poker playing slot machine is provided that allows a player to play simultaneously against an intelligent, simulated opponent and against a video-poker style payoff table. For a particular hand, a player may be awarded winnings based on the payoff table even if the player loses against the simulated opponent.

BRIEF DESCRIPTION OF THE DRAWINGS

FIG. 7A illustrates possible first round actions according to one embodiment of the invention.

FIG. 7B illustrates possible first round actions where raises are limited according to one embodiment of the invention.

FIG. 10 illustrates possible second round actions according to one embodiment of the invention.

FIG. 11 illustrates possible second round actions in a game where raises are limited according to one embodiment of the invention.

FIG. 13 illustrates actual columns for table 1200 of FIG. 12 according to an embodiment of the invention.

FIGS. 16A–16B provide values for action sequence triggering variables for example pot sizes of 3 and 5.

DETAILED DESCRIPTION OF THE INVENTION

A computer gaming system is described. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
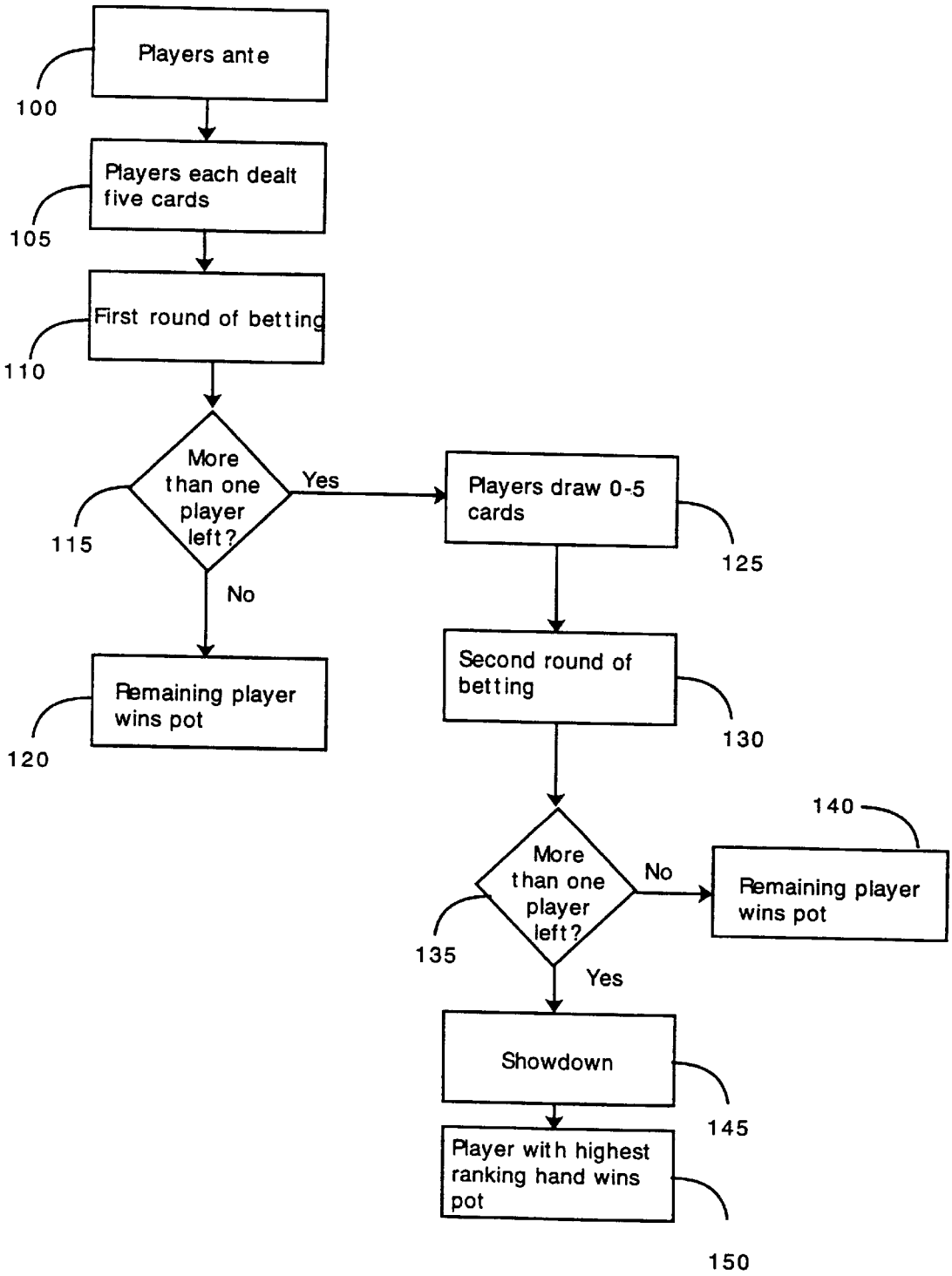
FIG. 1 is a flow chart illustrating a sequence of events in five card draw poker.
Figure 2:
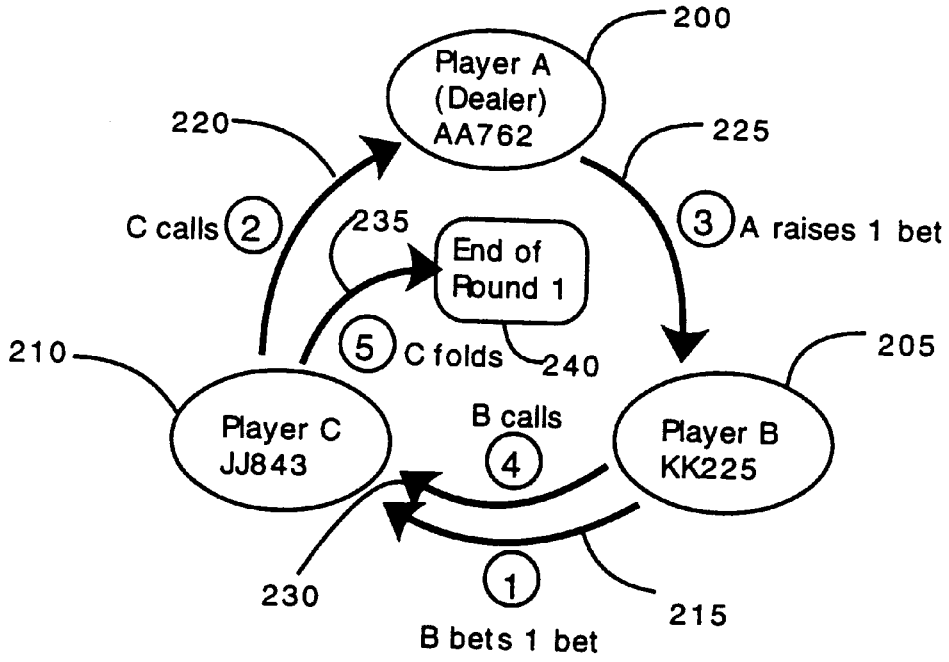
FIG. 2 is a schematic diagram illustrating a first round of betting.
Figure 3:
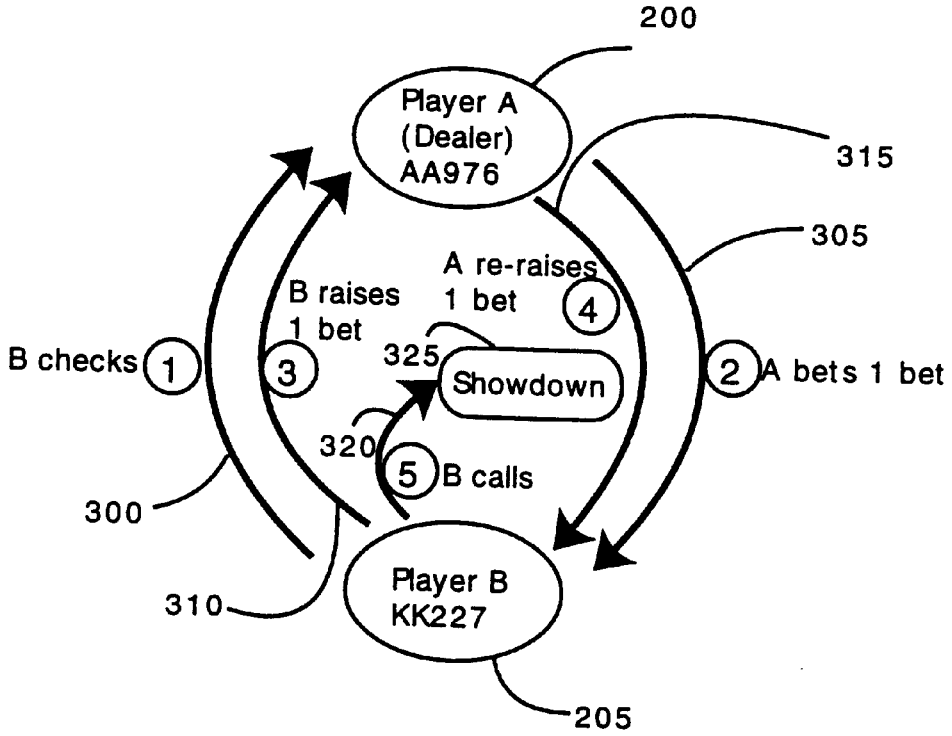
FIG. 3 is a schematic diagram illustrating a second round of betting.
Figure 4:
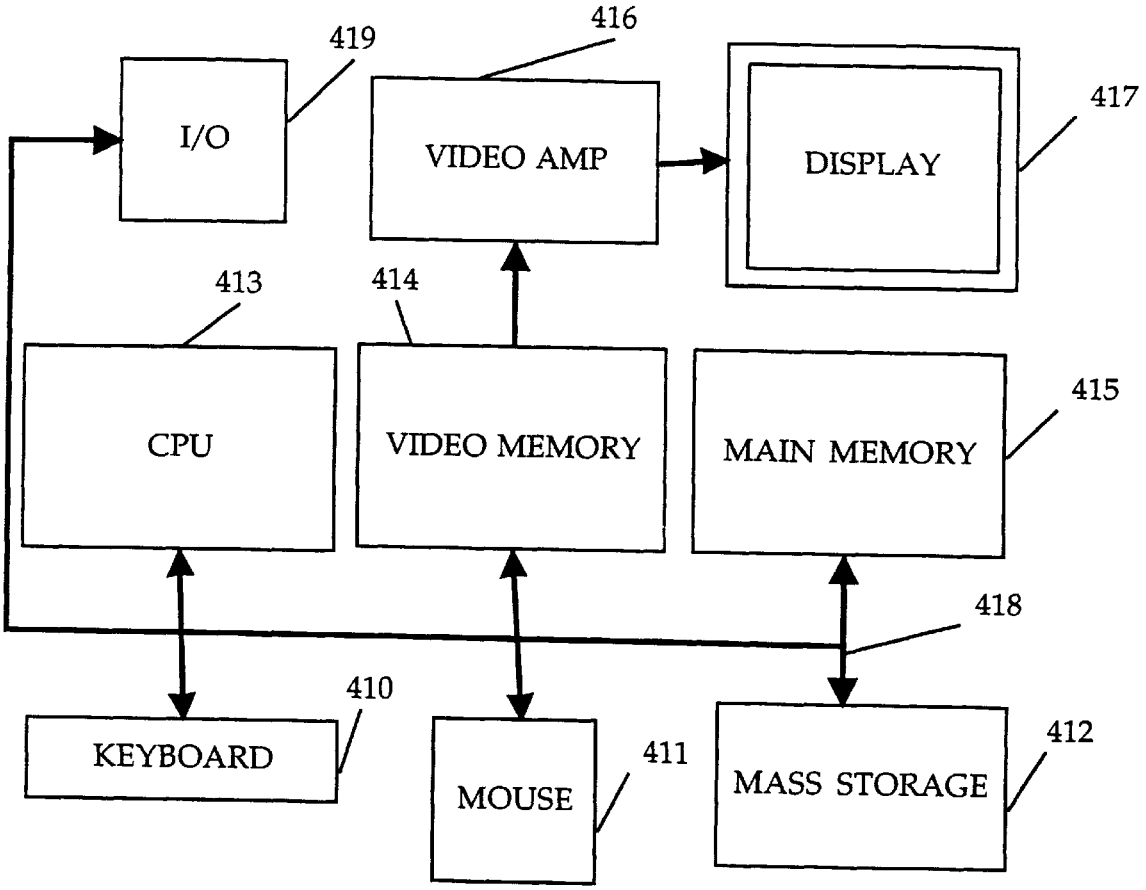
FIG. 4 provides an example of a general purpose computer that can be used with the present invention.

The present invention can be implemented on a general purpose computer such as illustrated in FIG. 4. A keyboard 410 and mouse 411 are coupled to a bidirectional system bus 418. The keyboard and mouse are for introducing user input to the computer system and communicating that user input to CPU 413. The computer system of FIG. 4 also includes a video memory 414, main memory 415 and mass storage 412, all coupled to bidirectional system bus 418 along with keyboard 410, mouse 411 and CPU 413. The mass storage 412 may include both fixed and removable media, such as magnetic, optical or magnetic optical storage systems or any other available mass storage technology. Bus 418 may contain, for example, 32 address lines for addressing video memory 414 or main memory 415. The system bus 418 also includes, for example, a 32-bit DATA bus for transferring DATA between and among the components, such as CPU 413, main memory 415, video memory 414 and mass storage 412. Alternatively, multiplex DATA/address lines may be used instead of separate DATA and address lines.

CPU 413 may be any suitable microprocessor such as, for example, the Pentium™ processor manufactured by Intel. Main memory 415 is comprised of dynamic random access memory (DRAM). Video memory 414 is a dual-ported video random access memory. One port of the video memory 414 is coupled to video amplifier 416. The video amplifier 416 is used to drive the cathode ray tube (CRT) raster monitor 417. Video amplifier 416 is well known in the art and may be implemented by any suitable means. This circuitry converts pixel DATA stored in video memory 414 to a raster signal suitable for use by monitor 417. Monitor 417 is a type of monitor suitable for displaying graphic images.

The computer system described above is for purposes of example only. The present invention may be implemented in any type of computer system or programming or processing environment. The invention may be implemented by means of software programming on this or another computer system.

Overview

Figure 5:
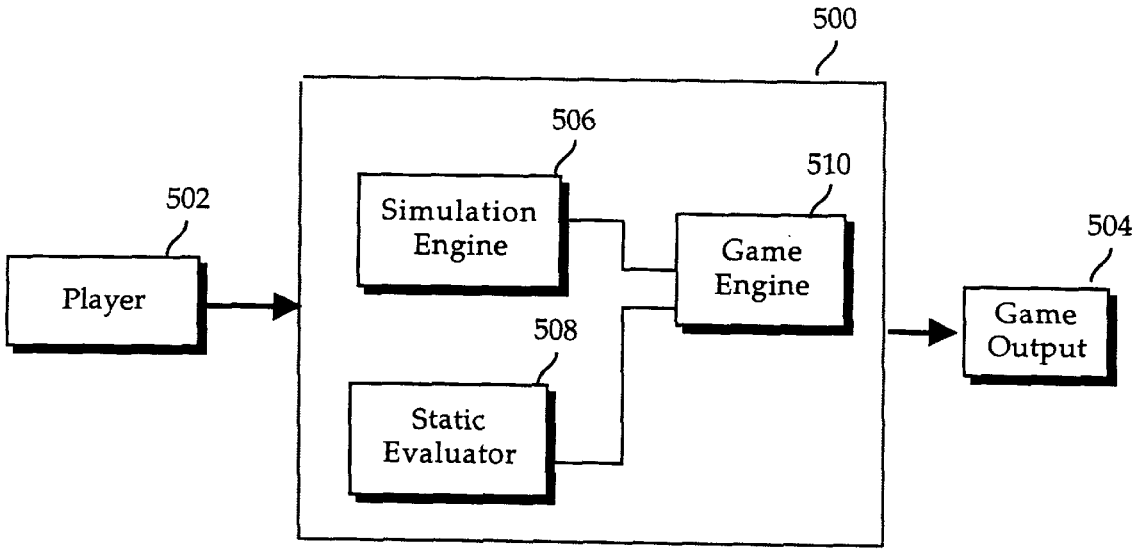
FIG. 5 provides an example of the system components according to one or more embodiments of the invention.

Embodiments of the invention comprise an intelligent gaming system in which a user-player is pitted against one or more intelligent, simulated opponents. In another embodiment, the gaming system further allows the user to play against an intelligent, simulated opponent and against a predetermined set of results or aspects of the game. In one embodiment, the gaming system is an intelligent poker playing system in which a user-player plays poker against an intelligent, simulated poker player and a predetermined payoff table. FIG. 5 provides an example of the system components according to an embodiment of the invention.

System 500 comprises game engine 510, simulation engine 506 and static evaluator 508. Game engine 510, simulation engine 506 and static evaluator 508 can be implemented as software that runs in the system of FIG. 4, for example. System 500 interacts with player 502 to obtain input from player 502. Simulation engine 506 generates actions for the simulated player that becomes input to game engine 510. Input from player 502 and simulation engine 506 is received and processed by game engine 510. System 500 generates output 504 that is displayed to player 502. Output 504 includes messages prompting player 502 for input, messages describing the action(s) taken by the simulated player, and status messages that describe an interim or final status of the game (i.e., whether the simulated player or player 502 is winning the game).

Simulation engine 506 identifies the action(s) that the simulated player takes during the course of a game. Simulation engine 506 evaluates the current state of the game including the actions that have already been taken by the players and chooses an action or actions for the simulated player from among the set of currently valid actions. The action(s) identified by simulation engine 506 and player 502 are processed by game engine 510.

Player 502 can compete against some static measurements in some embodiments of the invention. Static evaluator 508 compares some aspect or level of play by player 502 against a predetermined set of criteria. If player 502 achieves an acceptable level of play based on the predetermined set of criteria, player 502 wins the static competition.

Intelligent Poker Playing System

The invention is described herein with reference to an intelligent poker playing system and in particular to "five card draw." However, it should be apparent that the invention can be applied to other card games including other poker games (e.g., "five card stud," "seven card stud," "hold'em," and "Omaha"). The invention can be applied to any game in which strategies are used to identify an action during the game. The following provides a process flow for system 500 that implements a poker gaming system.

Further, the intelligent poker playing system is described using a single user-player pitted against one intelligent, simulated player. However, it should be apparent that the invention can be practiced with varying numbers of user-players and intelligent, simulated players. Thus, for example, one user-player can be pitted against more than one intelligent, simulated player, or vice versa. Further, multiple user-players can be pitted against multiple intelligent, simulated players.

In "five card draw," each player is dealt five cards after placing an initial bet. A player evaluates his hand and adopts a strategy for playing the hand. A player's strategy determines the action(s) taken by the player. For example, in a two player "five card draw" poker game, player 1, P1, can adopt one strategy, if he believes that his hand is likely to be a "winning" hand. In that case, P1 opens the betting and then reraises if player 2, P2, raises P1's bet. If P1 believes that his hand has less potential to beat P2's hand, P1 can adopt a strategy to open with a bet, but fold, if P2 raises P1's opening bet. Even if P1 believes his hand is not that strong, P1 may adopt a strategy to try to bluff P2 into believing that his hand is a "winning" hand. In that case, P1 can open with a bet and reraise P2's bet. P1's strategy may be simply to fold when P1 believes that his hand has no value.

P1 can modify or adopt a new strategy during the game. The size of the pot may cause P1 to change strategies, for example. Further, P1 may adopt different strategies between rounds (e.g., before and after the draw). Similarly, P2 can adopt one or more strategies during a game. Simulation engine 506 can simulate the play of either P1 or P2.

FIGS. 6A–6F provide a process flow for a video "five card draw" poker game between two players according to an embodiment of the invention. Either P1 or P2 is player 502 with the other being simulated using simulation engine 506. The simulated player can be P1 in one game and P2 in another game. After player 502 enters money (or credits or tokens), the cards are dealt to each player and a first round of betting commences.

At step 602, a determination is made whether player 502 has entered some amount of credit (or token). After player 502 enters credits, the game begins with each player contributing an initial amount to the pot (i.e., "an ante"). Alternatively, player 502 can cashout to retrieve the credits. Thus, at step 604, a determination is made whether player 502 "anted" or made a "cashout" request. If it is determined that player 502 entered a "cashout" request, processing continues at step 606 to return the player's credits. From step 606, processing continues at step 602 to await the start of another game.

If player 502 "anted", processing continues at step 610 to deal the cards to P1 and P2. At step 612 ("P1 action?"), a determination is made whether P1's action is to bet or to fold. If P1 folds at step 612, processing continues at step 614 to payout the pot to P2 (see FIG. 6F for an example of a payout and static evaluation process flow according to an embodiment of the invention). Processing continues at step 602 to await the start of another game or termination of play.

If P1's action was to bet at step 612, processing continues at step 616 to wait for P2's action. P2 has the option to fold, raise, or call. If P2 folds at step 616, processing continues at step 618 to process the payout to P1 and processing continues at step 602.

If P2 raises P1's bet, processing continues at step 624 to wait for P1's action. P1 can call, raise P2's raise, or fold. If P1 folds, the pot is paid out to P2 at step 626. If P1 raises P2's raise, processing continues at step 628 to wait for P2's response. If P2 raises P1's raise at step 628, processing continues at step 624 to await P1's action. The sequence of one player raising another player can continue until a raise limit is reached, or one player calls the other's raise. To implement a raise limitation, a step can be added to the steps of FIG. 6B to examine the number of raises against a raise threshold. If the number of raises has reached the threshold, a player's valid actions can be limited to either folding or calling. Further, if either P1 or P2 call the other player's bet (at steps 624 or 628, respectively), processing continues at step 632.

If either player calls the other player's bet, the first round of betting ends and processing continues at step 632 at which each player may draw cards. At step 632, P1 selects the cards to be discarded. A set of replacement cards is drawn by P1 at step 634. Similarly, at steps 636 and 638, P2 discards and draws zero or more cards.

Processing continues at step 644 (FIG. 6D) where the second round opens with P1's action. P1 can either pass (i.e., check) or bet. If P1 passes, processing continues at step 656

(FIG. 6E) to await P2's response. If P2 checks in response to P1's check, a showdown occurs with a payout being given at step 668 to the player with a highest ranking hand.

If P1 opens the second round of betting at step 644 with a bet, processing continues at step 646 to await P2's action. P2 can raise, call or fold in response to P1's bet. If P2 raises P1's bet, processing continues at step 660 to await P1's action. If P2 folds at step 646 after P1 opens with a bet, processing continues at step 648 to award the pot to P1. If P2 calls P1's bet, processing continues at step 650 to pay the pot to the player with the higher ranking hand.

If P2 raises P1's opening bet or bets after P1 passes, processing continues at step 660 to await P1's responsive action. P1 can call, fold or raise. In an embodiment in which check-raising is not allowed, however, P1 would only have the option to call or fold at step 660.

If P1 folds, the pot is paid to P2 at step 662. If P1 calls, the pot is paid to the player with the higher ranking hand. If P1 raises P2's bet, processing continues at step 664 to await P2's response. Steps 660 and 664 can repeated with each player responding to the other's raise until one of the player's calls, or runs out of money.

Payout and Static Evaluator

Figure 6A:
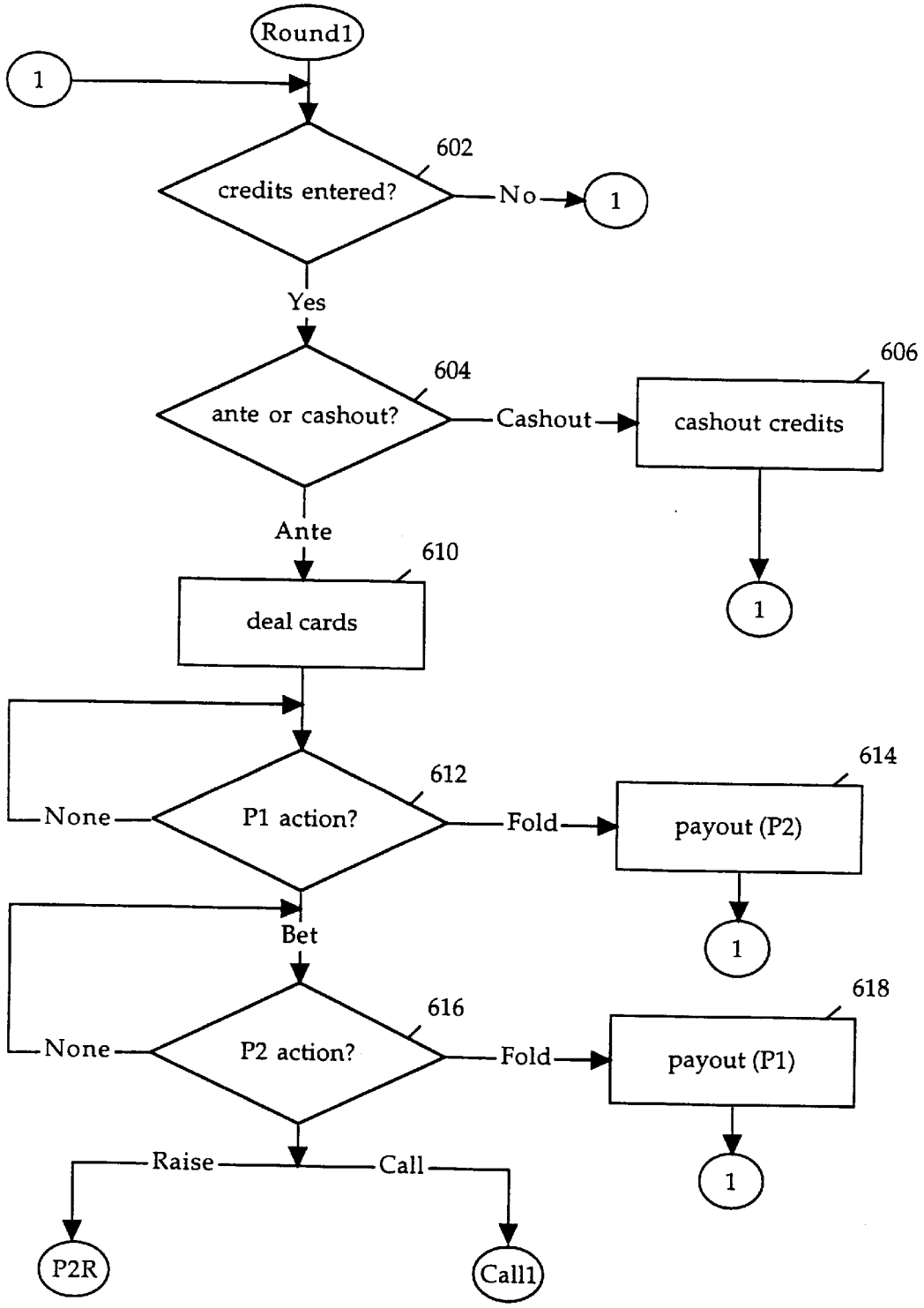
FIGS. 6A–6F provide a process flow for an intelligent "five card draw" poker game between two players according to an embodiment of the invention.
Figure 6B:
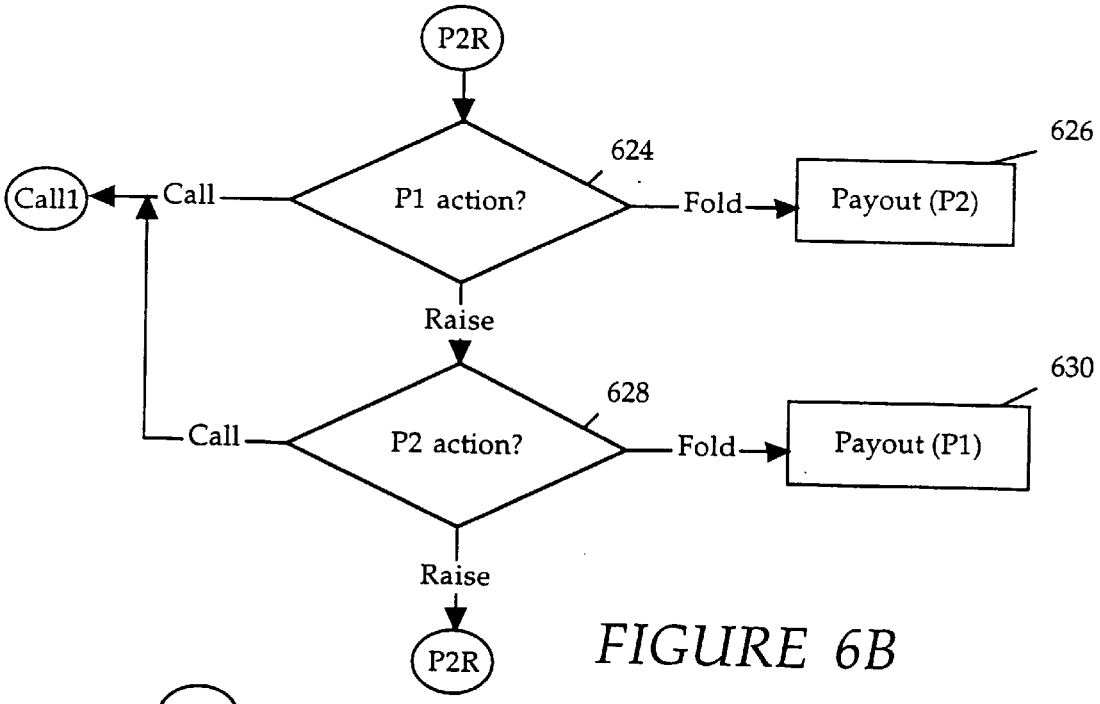
Figure 6C:
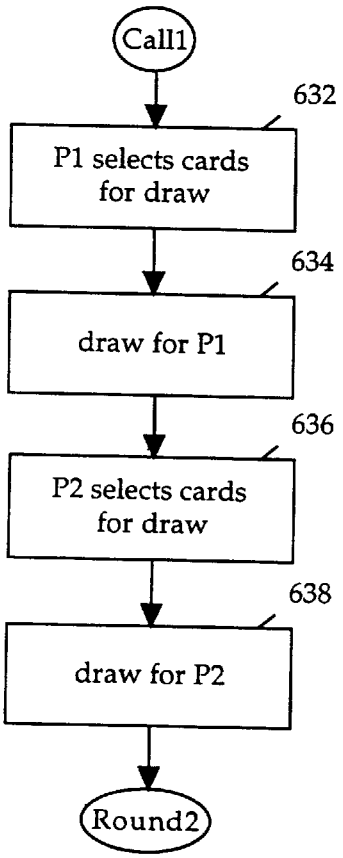
Figure 6D:
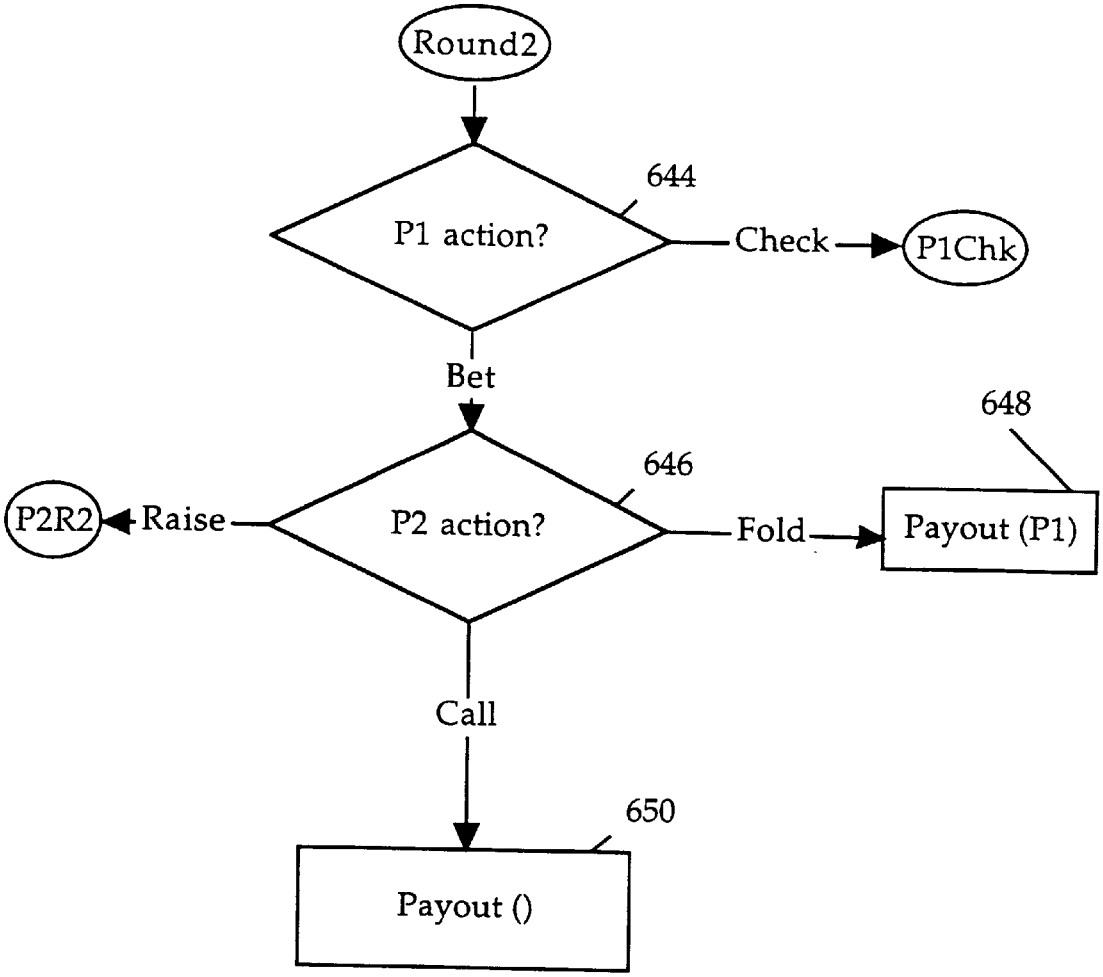
Figure 6E:
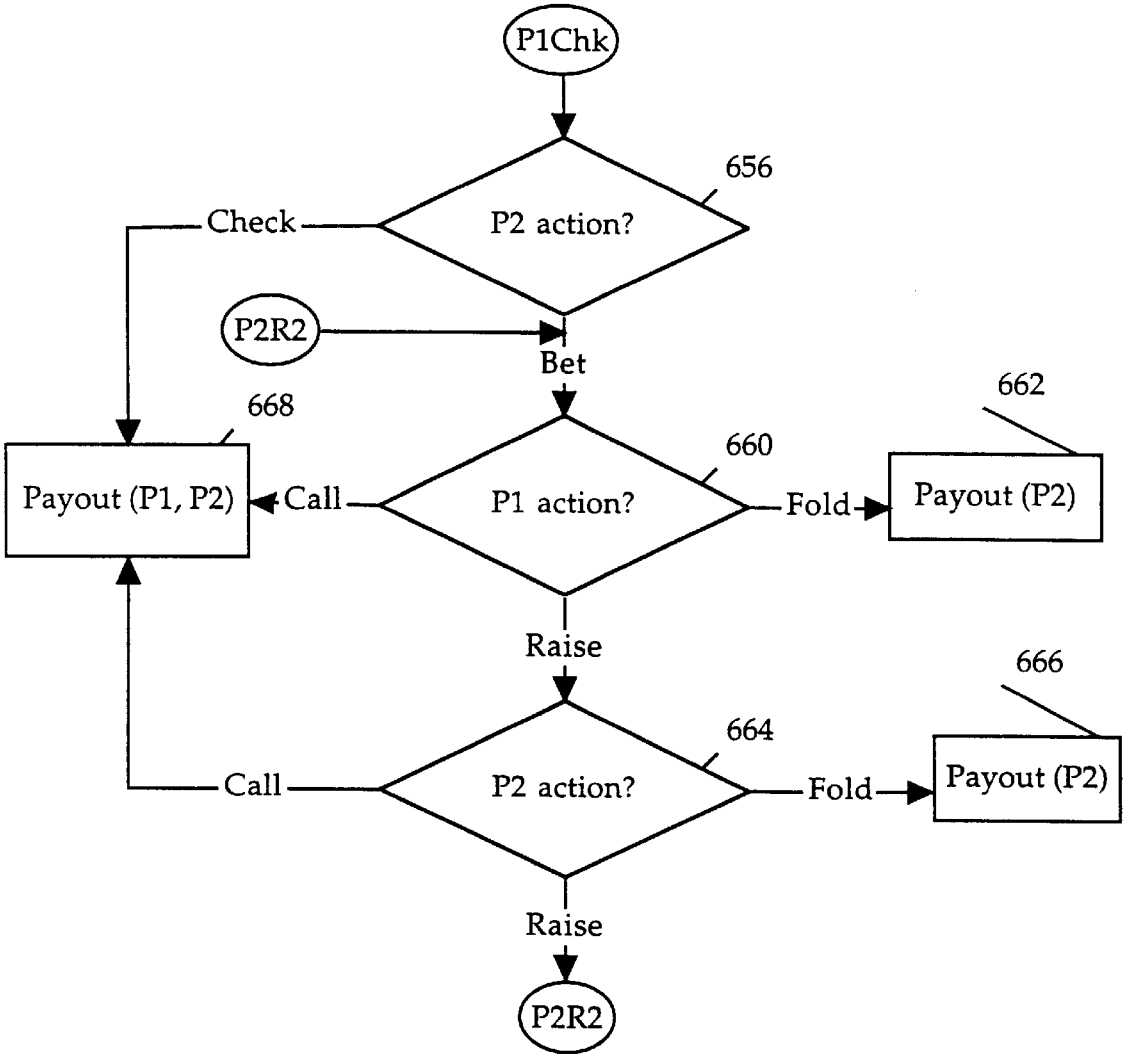
Figure 6F:
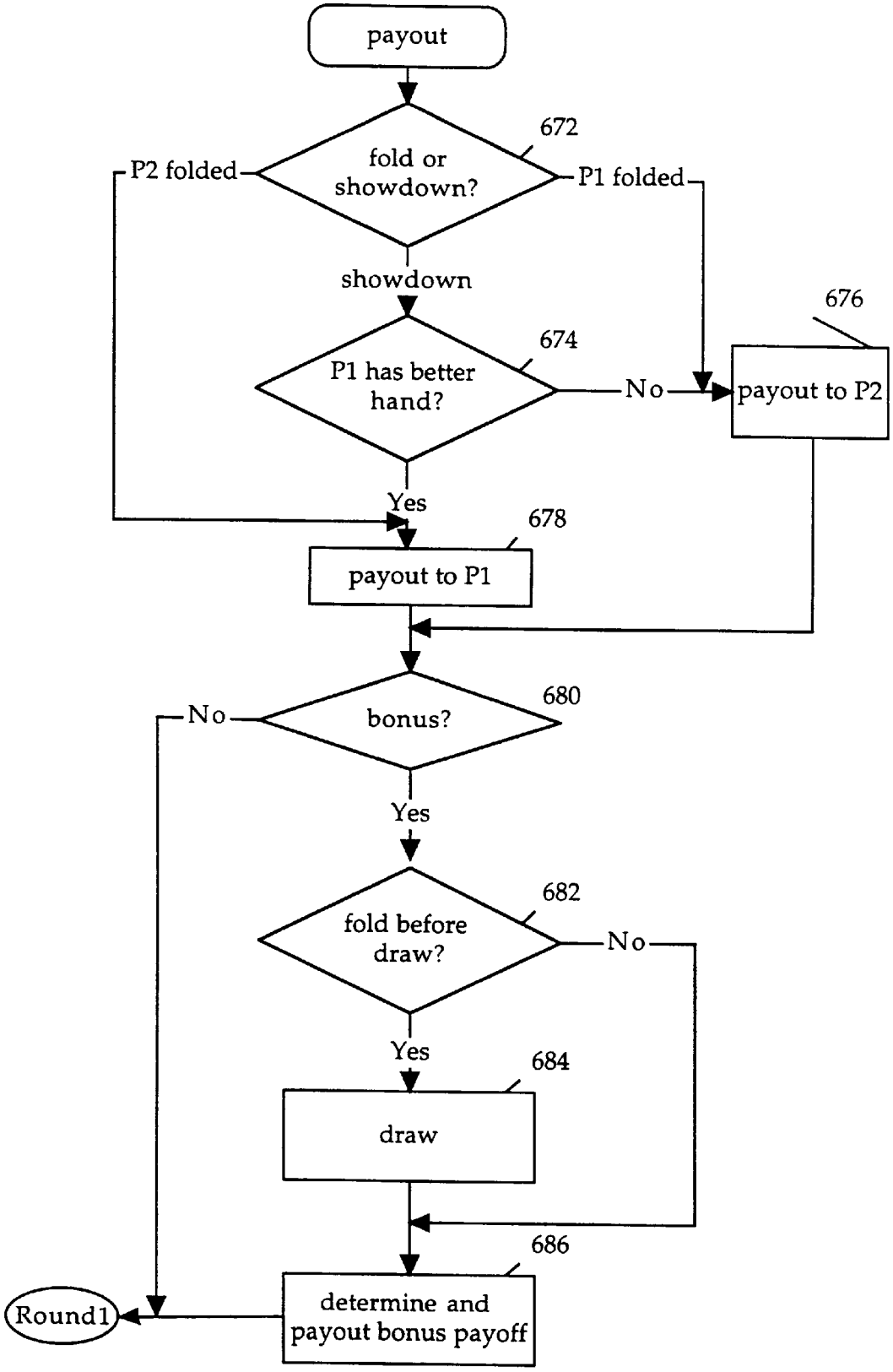

FIGS. 6A–6E refer to a payout step that awards the pot to the winner of the game. Where one of the players folds, the winner is the player that did not fold. Where neither folded and play ended in a showdown, the winner is the one having a higher ranking hand. The pot is paid to the winner. In an embodiment of the invention, the system further includes a payout to player 502 when player 502 has a hand ranking that meets or beats a threshold hand ranking. Static evaluator 508 compares player 502's hand and the threshold to determine whether player 502 is a winner. FIG. 6F provides an example of a payout and static evaluation process flow according to an embodiment of the invention.

At step 672, a determination is made whether the game ended in a showdown or because one of the players folded. If one of the players folded, processing continues by awarding the pot to the other player. Thus, if it is determined at step 672 that P1 folded, the pot is awarded to P2 at step 676. If P2 folded, the pot is awarded to P1 at step 678.

At step 680, if it is determined that the static evaluation feature of the system is active, processing continues at step 682 to allow player 502 to play against a predetermined payoff table (i.e., bonus play). The process flow of FIG. 6F allows player 502 to play the bonus round whether or not player 502 folded. Alternatively, static evaluator 508 can limit bonus play such that player 502 is prohibited from bonus play when player 502 folded.

At step 682, a determination is made whether the fold action occurred prior to the draw. If the game against the simulated player ended in the first round, static evaluator 508 allows player 502 to draw zero to five cards at step 684. After player 502 is allowed a draw (either in simulated or bonus play), static evaluator 508 determines whether a bonus is payable to player 502 and pays any such bonus at step 686. The determination is based on a predetermined set of criteria such as the ranking assigned to a player's hand. Referring to Table 1, for example, a threshold can be set at three of a kind. Thus, a bonus is paid for a hand rank in category six of Table 1 (i.e., three of a kind). The threshold for payment of a bonus can be raised or lowered. For example, the threshold can be raised to pay a bonus for hands in category 4.

A bonus can be paid based on a graduated payback structure for a hand that meets or exceeds the threshold. The amount paid as a bonus can be a set amount for each card ranking. Alternatively, a graduated bonus can be paid depending on the rank of the hand. Table 5 provides an example of a graduated bonus structure.

Table 5

| Graduated Payback | |
|---|---|
| Rank | Bonus |
| Pair of Jacks or Better | 1 |
| Two Pair | 2 |
| Three of a Kind | 3 |
| Straight | 4 |
| Flush | 5 |
| Full House | 8 |
| Four of a Kind | 80 |
| Straight Flush | 100 |
| Royal Flush | 488 |

In the graduated jackpot example provided in Table 5, a bonus is paid to player 502 for a hand ranking of a pair of jacks or better. If, for example, player 502 has three of a kind, he is paid 3 units (e.g., three dollars). If player 502 has a royal flush, he is paid 488 units. If player 502 has a pair of tens, he does not receive a payback.

Static evaluator 508 can be used to award a jackpot amount that reflects contributions from multiple players including player 502. When a player meets or exceeds the threshold ranking, the jackpot is paid out to that player. Player 502 can therefore compete against other system users to win the jackpot that includes the contributions made by other players into the jackpot. Each player plays against the predetermined bonus threshold. Each user can interact with the same or different instances of system 500 to contribute an amount to the bonus jackpot.

First Round

As illustrated in FIGS. 6A–6F, the first round of the intelligent poker playing system includes points at which a player (e.g., player 502 or the simulated player) must take an action. A player selects an action from the set of available actions that is a subset of the set of actions (e.g., pass or check, fold, call, bet and raise). P1 and P2 continue the first round until one of the players either calls or folds. FIG. 7A illustrates possible first round actions according to one embodiment of the invention.

Columns 720–728 identify the five action points in the first round. For example, column 720 corresponds to step 612 of FIG. 6A. Columns 722, 724, 726 and 728 correspond to steps 616, 624, 628, and 624, respectively, of FIGS. 6A–6B. Rows 700A–700B, 702A–702C, 704A–704C, 706A–706C, and 708A–708C indicate the specific actions available to the players. For example, column 720 (P1A1) represents the first action by P1. In this embodiment, according to rows 700A–700B, the possible actions for P1 for the P1A1 action are either bet or fold (in other embodiments, other actions for P1A1 may be allowed, such as, for example, bet or pass). If P1 folds, P2 is awarded the pot and play ends. Therefore, no actions are identified for columns 722–728.

Rows 702A–702C illustrate the possible first actions for P2 (P2A1), if P1A1 is a bet. Referring to column 722, P2A1 can be a fold, call or raise. If P2 folds in response to P1's bet (row 702A), the pot is paid to P1 and play ends. If P2 calls (row 702B) there is a showdown, and the pot is paid to the player with the highest hand. Rows 704A–704C illustrate the possible second actions for P1 (P1A2), if P2A1 is a raise (i.e., fold, call or raise). If P1A2 is a fold (row 704A), the pot is paid to P2 and play ends. If P1A2 is a call (row 704B), there is a showdown and the pot is paid to the player with the highest hand. If P1A2 is a raise, play turns to P2 for an action. P2's response (P2A2) is represented in rows 706A–706B. If P2A2 is a fold or call, play ends. If P2A2 is a raise, P1 can respond (P1A3) by folding, calling or raising (rows 708A–708C).

If P1 and P2 continue to raise as illustrated, play can continue (i.e., P1An and P2An). In fact, play can continue indefinitely until a player calls the other's bet, folds, or runs out of money. Referring to FIG. 6B, the process flow can continue at steps 624 and 628 until either P1 or P2 folds or calls. Alternatively, system 500 can limit the number of possible raises. That is P1 and P2 are limited in the number of times each can raise the other's bet.

FIG. 7B illustrates possible first round actions in a game where the number of raises is limited according to one embodiment of the invention. Referring to rows 700A–700B, P1A1 can be a fold or bet. As illustrated in rows 702A–702C, in response to a betting action for P1A1, P2A1 can be a fold, call or raise. However, referring to rows 714A–714B (P1A2), P1 is limited to either calling P2's raise or folding. Therefore, the first round is guaranteed to end no later than P1A2.

The available actions for P1 and P2 are illustrated in FIGS. 7A–7B. A player must choose an action at each action point (e.g., P1A1, P2A1, P1A2, etc.). A player typically develops a strategy for playing and selects an action based on the strategy. A player's strategy determines the action(s) taken by the player. A player's strategy in the first round is typically based on the player's hand. A hand that a player believes to be a "winning" hand may prompt a different strategy than one that the player believes is a "losing" hand. For example, a player may consider that three of a kind or better is a "winning" hand. Another player may consider that two pair or better to be a "winning" hand. Conversely, one pair or lower may be considered a "losing" hand. Thus, for example, a player may fold with a one pair or lower hand. However, a player may adopt the strategy typically used with a "winning" hand even though he perceives his hand to be a "losing" hand in an effort to bluff the other player into folding.

Example Embodiment of First Round Strategy

In the first round, it is assumed that P1 and P2 have an equal chance of winning. That is, each player has an equal chance of being dealt a "winning" hand. In one embodiment, the initial strategy used by either player is based on the rank of the player's hand. In another embodiment of the invention, the initial strategy based on a hand's rank is ignored in favor of another strategy. The strategy identifies the action a player takes at an action point, and the actions taken to reach an action point. In a preferred embodiment, the first round strategy further identifies the number of cards the player is to draw at the conclusion of round one.

Since player 502 can be either P1 or P2, a technique is provided to identify a first round strategy for either P1 or P2. While a particular strategy identifies the action to take given the other player's action, the selection of the simulated player's strategy is independent of the strategy adopted by player 502. Thus, the simulated player's strategy is not simply an imitation of the action(s) taken by player 502.

In one embodiment of the invention, a set of first round action sequence triggering variables are identified that identify a player's strategy. Each variable has an associated numeric value that represents the percentage of times that a player adopts the strategy associated with the variable. The strategy identifies the action to be taken by a player at the player's action points.

In addition, the strategy identifies the drawing action. For certain hands, the number of cards to draw is straightforward based on the player's hand. For example, both P1 and P2 draw no cards with any straight, flush or full house; draw 1 card with two pair; draw three cards with a pair; draw three cards with an ace-high hand. P1 will occasionally draw 1 card to four-card flushes or four-card straights, or may bluff and stand pat (draw no cards) with an otherwise non-betting hand. A strategy specifies a particular number of cards for the draw, or specifies that the draw is based on the hand.

One set of action sequence triggering variables is associated with P1 while another set is associated with P2. Each player's variables are used to determine the action sequences associated with a particular strategy used in round one. The values assigned to each variable are used to determine whether or not to adopt the action(s) associated with the variable. Table 6 provides examples of variables used to determine P1's first round strategy as well as sample values and descriptions. It should be apparent that other values can be used for these variables and that other variables can be used as a supplement or replacement for these variables.

TABLE 6

| | Player 1 Variables | | | |
|---|---|---|---|---|
| Variable Name | Action 1 (P1A1) | Action 2 (P1A2) | Value | Description |
| p1PatBluffP | bet | | 0.003664 | Probability that P1 bluffs and stands pat with a no pair hand |
| P14fc | bet | call | 0.8435 | Probability that P1 bets and calls, if raised by P2, with a four flush hand and draws 1 card. |
| p14fb | bet | fold | 1.0 | Probability that P1 bets with a four flush hand and then folds (if raised) or draws 1 card (if P2 called). |
| p14sb | bet | fold | 0.24 | Probability that P1 bets with a four straight hand and then folds (if raised) or draws 1 card (if P2 called). |
| p1qlop | bet | fold | 0.0 | Probability that P1 opens (bets) with a queen high or lower hand. |
| p1qlca | bet | call | 0.0 | Probability that P1 opens and calls (if raised) with a queen high or lower hand |
| p1khop | bet | fold | 0.28 | Probability that P1 opens with a king high hand. |
| p1khca | | call | 0.0 | Probability that P1 calls with a king high hand. |
| p1ahop | bet | | 1.0 | Probability that P1 opens with an ace high hand or better. |
| p1ahca | bet | call | 1.0 | Probability that P1 calls with an ace high hand or better. |

Note: P1 bets and calls if raised with all hands better than ace high.

The strategies associated with the variables of Table 6 assume a game in which raises are limited as described with reference to FIG. 7B. Referring to FIG. 7B, P1 has two action points, P1A1 and P1A2, in round one. The possible actions for P1A1 are fold or bet. If the strategy specifies that P1A1 is a bet action, a P1A2 action is specified. The possible P1A2 actions are fold or call. Thus, if P2 raises in response to a P1A1 bet action, P1A2 specifies whether P1 is to call or fold in response to P2's P2A1 action. The strategy adopted by P1 identifies the actions for the P1A1 action point and, if necessary, the P1A2 action point.

The strategy that is adopted by P1 is determined using the variables identified in Table 6. A value is assigned to a variable that represents the percentage of time that a variable's strategy is adopted. This value is examined before a variable's strategy is adopted. For example, a value of 50 percent (i.e., 0.50) associated with a variable suggests that the variable's strategy should be adopted fifty percent of the time. A random number is used in one embodiment that ranges from 0 to 1. A variable's percentage is compared against the random number to determine whether the variable's action(s) is used.

Each variable is associated with a hand rank. That is, one or more variables are selected to determine a player's strategy based on the ranking of the player's hand. Table 7 categorizes the variables of Table 6 into their respective rankings.

Table 7

| Player 1 Variables | |
|---|---|
| Hand | Variables Player 1 |
| Straight Flush | * |
| Four of a Kind | * |
| Full House | * |
| Flush | * |
| Straight | * |
| Three of a Kind | * |
| Two Pair | * |
| One Pair | * |
| No Pair | p1PatBluffp |
| Ace High | p1ahop, p1ahca |
| King High | p1khop, p1khca |
| Queen High | p1qlop, p1qlca |
| Four Flush | p14fc, p14fb |
| Four Straight | p14sb |

*P1 always bets and calls if raised with all hands better than ace-high.

To illustrate, assume that P1 has a four flush hand. Referring to Table 7, the p14fc and p14fb variables are associated with a four flush. Referring to Table 6, if the strategy suggested by the p14fc variable is adopted, P1 bets at action point P1A1 and calls at action point P1A2. If the p14fb variable is used, P1 bets at action point P1A1 and folds at action point P1A2. The values associated with the p14fc and p14fb variables are used to determine which strategy (i.e., the bet-call strategy of p14fc or the bet-fold strategy of p14fb) is adopted. The values assigned to the p14fc and p14fb variables are 0.8435 and 1.0, respectively. That is, the bet-call strategy is adopted eighty-five percent of the time when P1 receives a four flush. The remaining portion of the time, the bet-fold strategy is adopted for P1.

Figure 8A:
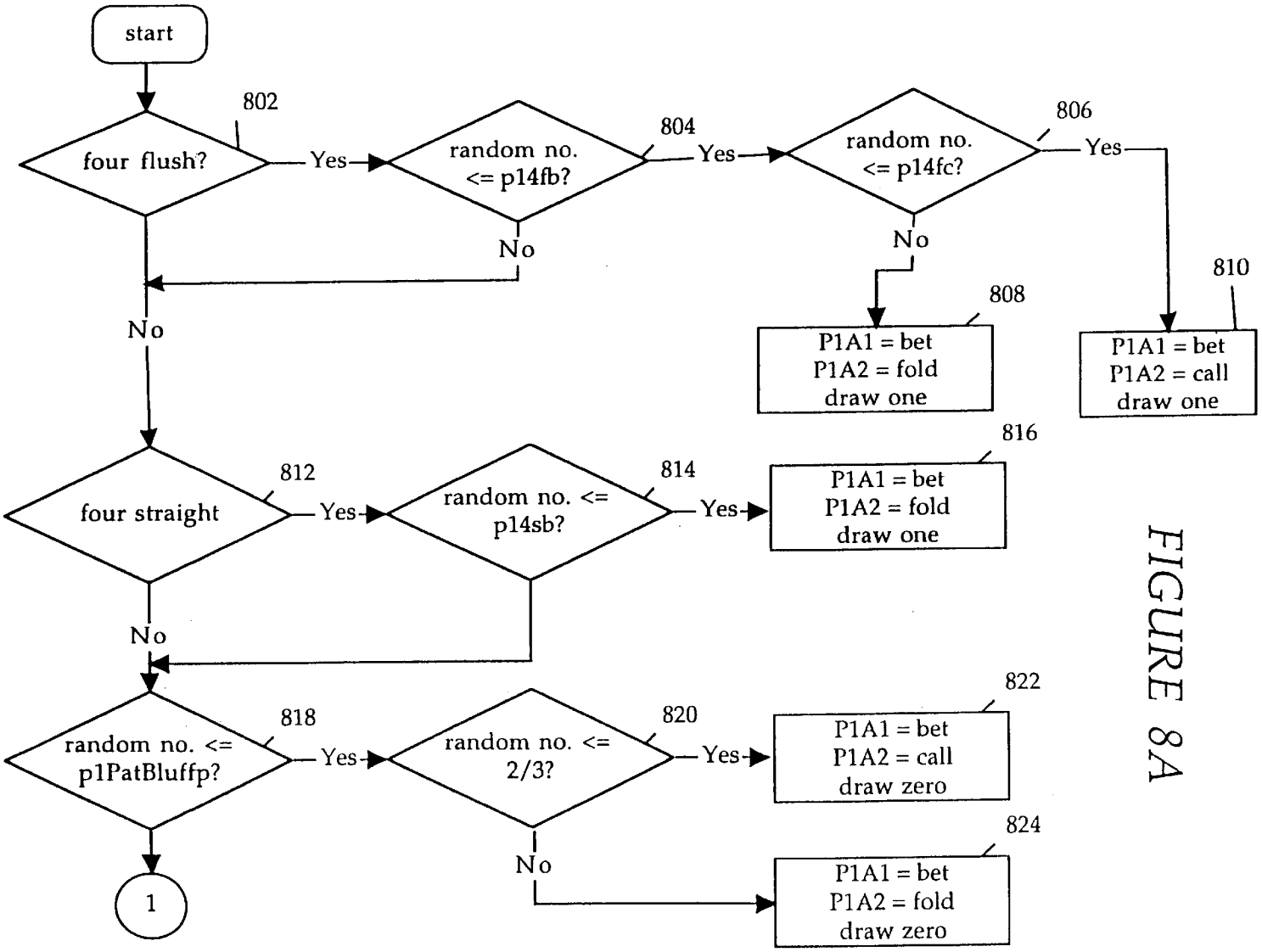
FIGS. 8A–8C provide a process flow for identifying a first round strategy for player P1 according to an embodiment of the invention.
Figure 8B:
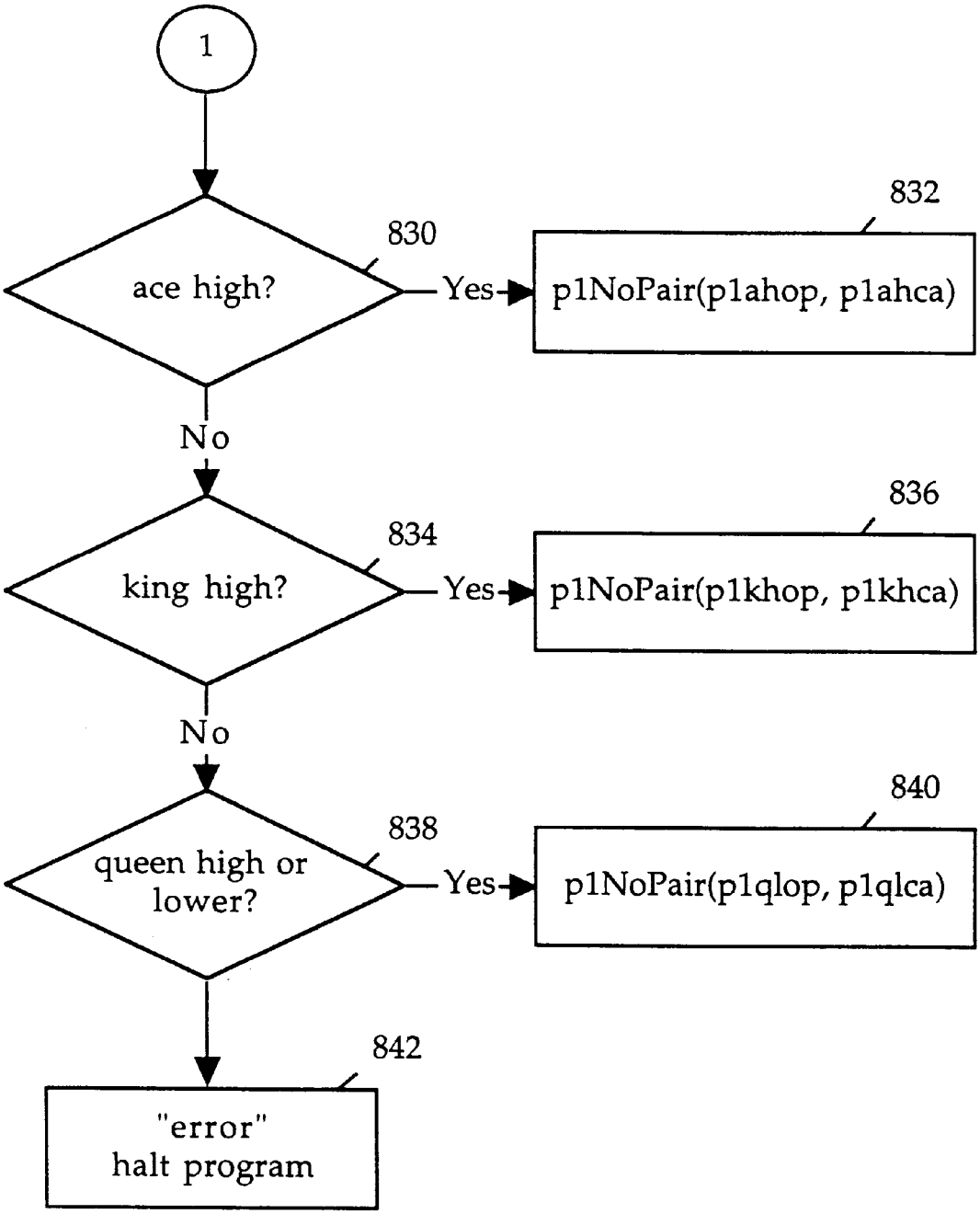
Figure 8C:
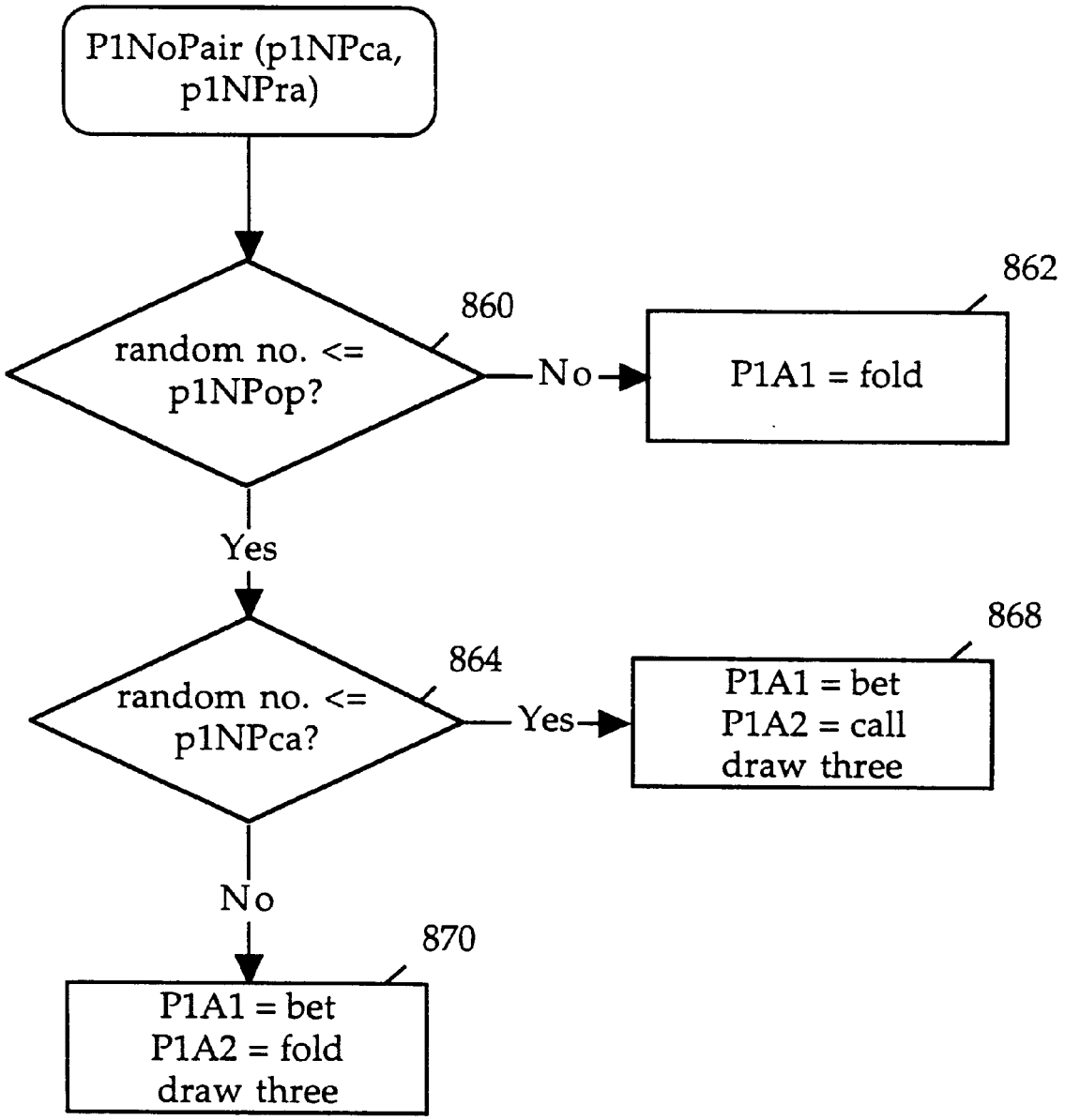

FIGS. 8A–8C provide a process flow for identifying a first round strategy for player P1 when P1 receives a hand with a rank less than one pair according to an embodiment of the invention. If P1 receives a hand with a rank of greater than or equal to one pair, P1 will adopt the bet-call strategy. Once the ranking of the hand is determined, the variables associated with the ranking are used to select a strategy and identify the action(s) to be taken by P1. Where a draw action is not determined based on the hand, a specific draw is specified for P1. In some cases, a random number is compared against the value of a variable in Table 7 to determine whether to adopt the strategy associated with the variable.

At step 802, a determination is made whether P1 has a four flush. If so, processing continues at step 804 to determine whether the random number is less than or equal to p14fb. If not, processing continues at step 812. If it is determined, at step 804, that the random number is less than or equal to p14fb, processing continues at step 806. A determination is made at step 806 whether the random number is less than or equal to p14fc. If not, processing continues at step 808 to specify a bet action for P1A1, a fold action for P1A2, and a one card draw. If the random number is less than or equal to p14fc, processing continues at step 810 to specify a bet action for P1A1, a call action for P1A2, and a one card draw.

If it is determined (at step 802) that P1 does not have a four flush or that the random number is greater than p14fb (at step 804), processing continues at step 812. A determination is made at step 812 whether P1 has a four straight. If so, processing continues at step 814 to determine whether the random number is less than or equal to p14sb. If not, processing continues at step 818. If the random number is determined to be less than p14sb at step 814, processing continues at step 816 to specify a bet action for P1A1, a fold action for P1A2, and a one card draw.

In the preceding steps, a determination is made whether P1 should bluff with a four flush or four straight hand. In steps 818 and 820, a determination is made whether to bluff even though a bluff is not indicated in the preceding steps. Thus, at step 818, a determination is made whether the random number is less than or equal to p1PatBluffp. If so, processing continues at step 820 to determine whether the random number is less than or equal to two-thirds. If not, processing continues at step 824 to specify a bet action for P1A1, a fold for P1A2and no draw. If so, processing continues at step 822 to specify a bet action for P1A1, a call action at P1A2and no draw.

Whether or not a bluff is indicated in steps 818 and 820, processing continues at step 830 to determine whether P1 has an ace high or better (step 830), king high (step 834), or queen high or lower hand (step 838). If so, processing continues at 860 of FIG. 8C to compare the variables associated with P1's particular hand with the random number. Steps 830, 834, and 838 reference the flow of FIG. 8C and specify the variables that are used in the steps of FIG. 8C. For example, if it is determined at step 834 that P1's hand is a king high hand, variables p1khop and p1khca are used with the steps of FIG. 8C. That is, p1NPop is equivalent to p1khop and p1NPca is equivalent to p1khca.

Referring to FIG. 8C, a determination is made whether the random number is less than or equal to p1NPop (e.g., p1NPop is equivalent to p1qlop where P1 has a queen high or lower hand). If not, processing continues at step 862 to specify a fold action for P1A1. If so, processing continues at step 864 to determine whether the random number is less than or equal to p1NPca (e.g., p1NPca is equivalent to p1qlca where P1 is a queen high or lower hand). If not, processing continue at step 868 to specify a bet action for P1A1, a call action for P1A2, and a three card draw. If the random number is greater than p2NPca, processing continues at step 870 to specify a bet action for P1A1, a fold action for P1A2, and a three card draw.

A set of variables are also defined for P2 that are used to determine P2's first round strategy. Table 8 provides examples of variables used to determine P2's first round strategy as well as sample values and descriptions. It should be apparent that other values can be used for these variables and that other variables can be used as a supplement or replacement for these variables.

TABLE 8

| Variable Name | Action 1 (P2A1) | Value | Description |
|---|---|---|---|
| Player 2 Variables | | | |
| p2PatBluffp | raise | 0.002597 | Probability that P2 bluffs by standing pat. |
| p24FBluffp | raise | 0.8435 | Probability that P2 bluffs as having two pair and draws one with a four flush. |
| p2NoPairBluffP | raise | 0.12 | Probability that P2 raises and draws three cards with a no pair hand |
| p2qlca | call | 0.0 | Probability that P2 calls with a queen high or lower hand. |
| p2qlra | raise | 0.12 | Probability that P2 raises with a queen high or lower hand. |
| p2khca | call | 0.0 | Probability that P2 calls with a king high hand. |
| p2khra | raise | 0.12 | Probability that P2 raises with a king high hand. |
| p2ahca | call | 0.3 | Probability that P2 calls with an ace high hand. |
| p2ahra | raise | 0.12 | Probability that P2 raises with an ace high hand. |
| p2raise | raise | 0.0–1.0 | Probability that P2 raises with a particular pair. |
| p2call | call | 0.0–1.0 | Probability that P2 calls with a particular pair. |
| p2fold | fold | 1.0-p2raise-p2call | Probability that P2 folds with a particular one pair hand. |

Note: P2 raises with all hands better than a pair.

The strategies associated with the variables of Table 8 assume a game in which raises are limited as described with reference to FIG. 7B. That is, P2 has one action point, P2A1. At P2A1, P2 can fold, call or raise the opening bet by P1. The strategy adopted by P2 identifies the action for the P2A1 action point. The strategy that is adopted by P2 is determined using the variables identified in Table 8 and the rank of P2's hand.

As with P1's variables, a value is assigned a variable that represents the percentage of times that a variable's strategy is adopted. Further, each variable is associated with a hand rank. Table 9 categorizes the variables of Table 8 based on their associated hand.

TABLE 9

| Hand | Variables Player 2 |
|---|---|
| Hands and Associated P2 Variables | |
| Straight Flush | * |
| Four of a Kind | * |
| Full House | * |
| Flush | * |
| Straight | * |
| Three of a Kind | * |
| Two Pair | * |
| One Pair | p2raise, p2call |
| No Pair | p2NoPairBluffp, p2PatBluffp |
| Ace High | p2ahca, p2ahra |
| King High | p2khca, p2khra |
| Queen High | p2qlca, p2qlra |
| Four Flush | p24FBluffp |
| Four Straight | p2PatBluffp |

*P2 raises with all hands better than a pair.

Figure 9A:
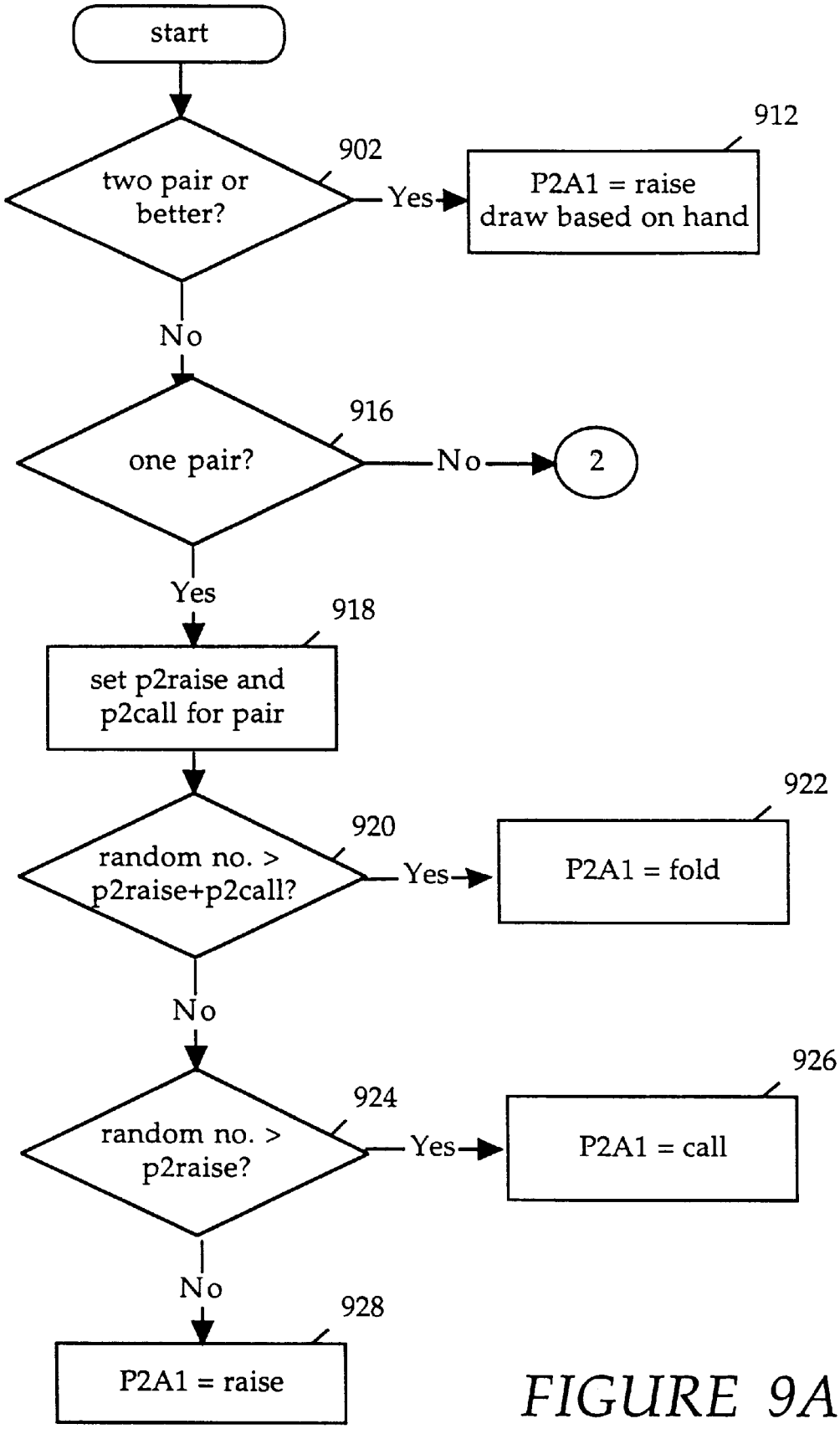
FIGS. 9A–9C provide a process flow for identifying a first round strategy for player P2 according to an embodiment of the invention.
Figure 9B:
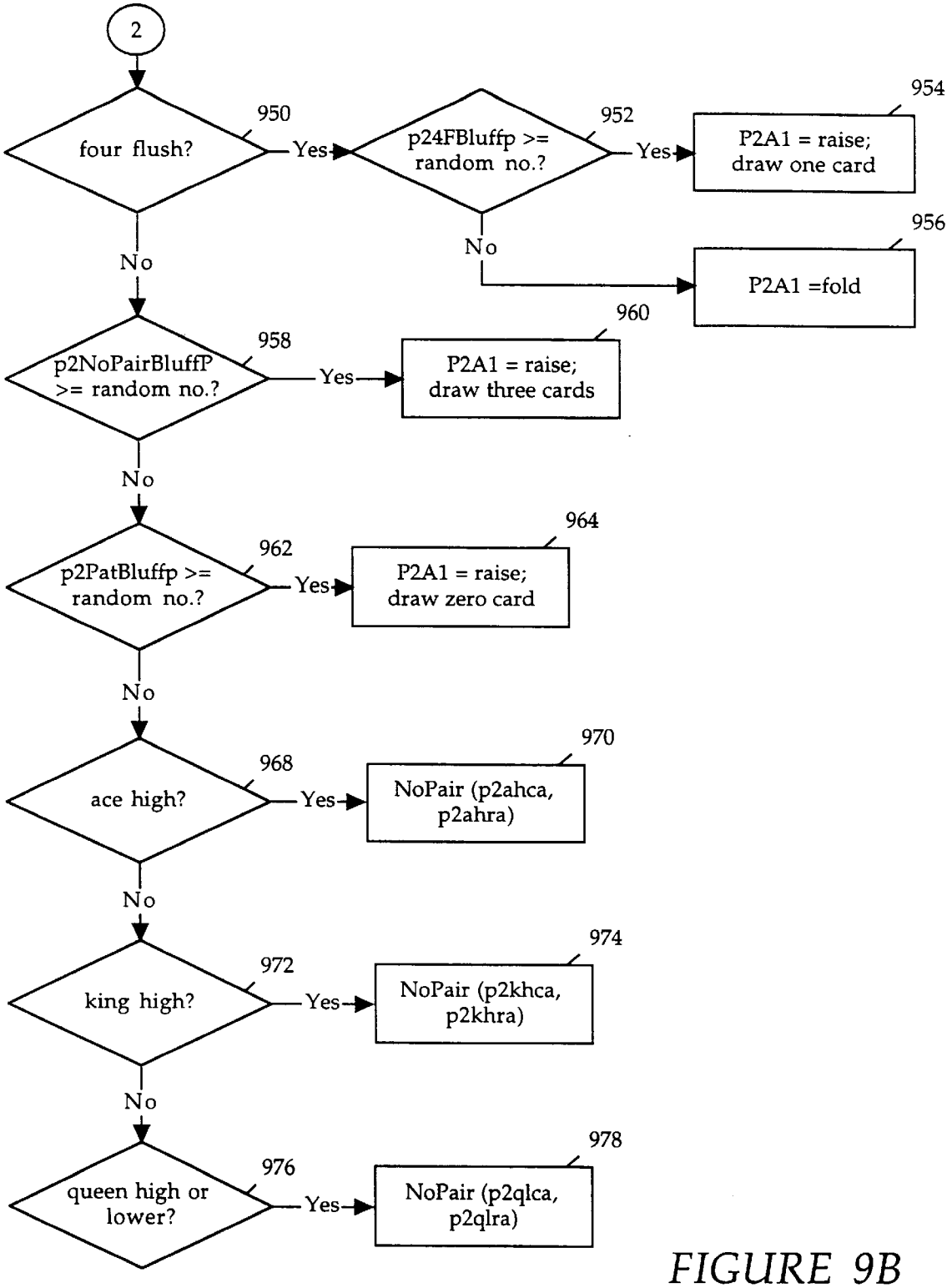
Figure 9C:
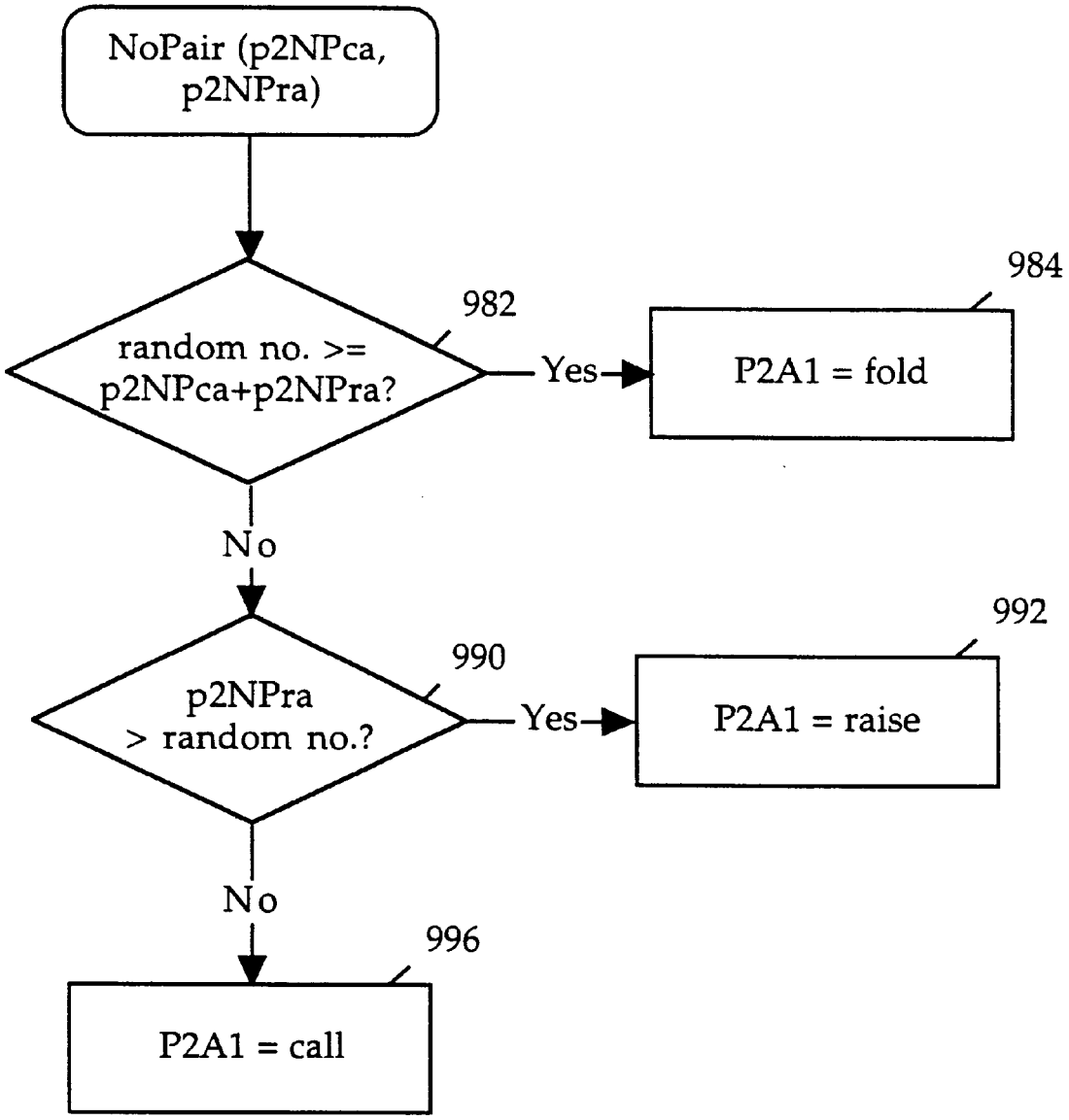

FIGS. 9A–9C provide a process flow for identifying a first round strategy for player P2 according to an embodiment of the invention. A ranking for P2's hand is identified. Once the ranking is determined, the variables associated with the ranking are used to select a strategy and identify the action (s) to be taken by P2. Where a draw action is not determined based on the hand, a specific draw is specified for P2.

At step 902 a determination is made whether P2's hand is a two pair or better hand. If P2 as a two pair or better hand (e.g., a straight), processing continues at step 912 to specify a raise action for P2A1 and a draw based on P2's hand.

If it is determined at step 902 that P2 has less than a two pair hand, processing continues at step 916 to determine whether P2 has a one pair hand. If so, processing continues at step 918 to obtain values for the variables p2raise and p2call given the actual one pair in P2's hand. Table 10 provides an example of values assigned to the p2raise and p2call variables for each pair type in one embodiment.

TABLE 10

| Pair | p2raise | p2call |
|---|---|---|
| Hands and Associated P2 Variables | | |
| Twos | 0.0 | 0.0 |
| Threes | 0.0 | 1.0 |
| Fours | 0.0 | 1.0 |
| Fives | 0.0 | 1.0 |
| Sixes | 0.75 | 0.25 |
| Sevens | 1.0 | 0.0 |
| Eights | 0.9 | 0.1 |
| Nines | 0.5 | 0.5 |
| Tens | 0.2 | 0.8 |
| Jacks | 1.0 | 0.0 |
| Queens | 1.0 | 0.0 |
| Kings | 1.0 | 0.0 |
| Aces | 1.0 | 0.0 |

The values of p2raise in Table 10 indicate the percentage of time that P2 raises with the given pair. The values of p2call indicate the percentage of time that P2 calls, but does not raise. Thus, for example, with a pair of sixes, P2 raises 75% of the time, and calls the remaining 25% of the time. P2 folds the remaining portion of the time, if any. Thus, p2fold=1-p2raise-p2call.

Other values for p2raise or p2call can be associated with each pair. Once values are obtained for p2raise and p2call at step 918, processing continues at step 920 to determine whether the random number is greater than the sum of p2raise and p2call. If so, processing continues at step 922 to specify a fold action for P2A1. If not, a determination is made at step 924 as to whether the random number is greater than p2raise. If yes, a call action is specified for P2A1 at step 926. If no, processing continues at step 928 to specify a raise action for P2A1.

If it is determined at step 916 that P2's hand is lower than one pair, processing continues at step 950 to determine whether P2 has a four flush hand. If so, processing continues at step 952 to determine whether to bluff with a four flush hand. A determination is made whether p24FBluffp is greater than or equal to the random number. If not, processing continues at step 956 to specify a fold action for P2A1. If so, processing continues at step 954 to specify a raise action for P2A1 and a one card draw.

If it is determined at step 950 that P2 does not have a four flush hand, processing continues at step 958 to determine whether p2NoPairBluffP is greater than or equal to the random number. If so, processing continues at step 960 to specify a raise for P1A1 and a three card draw. If it is determined at step 958 that p2NoPairBluffP is less than the random number, processing continues at step 962. A determination is made at step 962 whether p2PatBluffp is greater than or equal to the random number. If so, processing continues at step 964 to specify a raise for P2A1, and a zero draw.

If a bluff strategy is not adopted for P2, processing continues at steps 968, 972 and 976 to determine whether P2 has an ace high, king high, or queen high or lower hand. In each case, processing continues at step 982 to examine the variables associated with the ace high, king high or queen high or lower hands to determine whether P2 should raise, call or fold in response to an opening bet by P1. Depending on the outcome of steps 968, 972, and 976, the steps of FIG. 9C are performed using the variables associated with an ace high, king high or queen high or lower hand. For example, if it is determined at step 972 that P2 has a king high hand, processing executes the steps of FIG. 9C are processed using the p2khca and p2khra variables. The variables are referred to generically as p2NPca and p2NPra, respectively. Similarly, if it is determined at step 976 that P2 hand is a queen high or lower hand, the steps of FIG. 9C are performed using the p2qlca and p2qlra variables.

Referring to FIG. 9C, a determination is made at step 982 as to whether the random number is greater than the sum of p2NPra and p2NPca. If so, processing continues at step 984 to specify a fold operation for P2A1. If not, processing continues at step 990.

At step 990, a determination is made whether the p2NPra is greater than the random number. If yes, processing continues at step 992 to specify a raise operation for P2A1. If not, processing continues at step 996 to specify a call operation for P2A1.

Second Round

Like the first round of the intelligent poker playing system, the second round includes points at which a player (e.g., player 502 or the simulated player) must take an action. A player selects an action from the set of available actions that is a subset of the set of actions (e.g., pass or check, fold, call, bet and raise). If raising is unlimited, the second round continues until one of the players either calls or folds. FIG. 10 illustrates possible second round actions according to one embodiment of the invention.

Columns 1020–1028 identify five action points in the second round. For example, column 1020 corresponds to step 644 of FIG. 6D. Column 1022 corresponds to step 646 if P1's for action is a bet, or to step 656 when P1 checks. Columns 1024, 1026 and 1028 correspond to steps 660, 664, and 660, respectively. Rows 1000A–1000B, 1002A–1002C, 1004A–1004C, 1006A–1006C, 1008A–1008C and 1010A–1010C indicate the specific actions available to the players at given action points. For example, column 1020 (P1A1) represents the first action by P1. Rows 1000A–1000B identify the possible actions for P1 at the P1A1 action point (e.g., check or bet). At the P1A1 action point, no other actions have yet taken place. Therefore, no actions are identified for columns 1022–1028.

Rows 1002A–1002C illustrate the first actions for P2 (P2A1), if P1A1 is a check. Referring rows 1002A–1002B in column 1022, P2A1 can be a check or bet. If P2 checks in response to P1's check (row 1002A), there is a showdown. The pot gets paid to the player with the highest hand, and the game ends. Rows 1004A–1004C indicate that the first action for P2 can be a fold, call or raise if P1A1 is a bet. Rows 1006A–1006C through 1010A–1010C illustrate the possible actions for P1A2, P2A2 and P1A3, respectively as either fold, call or raise actions.

If P1 and P2 continue to raise, play can continue (i.e., P1An and P2An). In fact, second round play can continue indefinitely until a player calls the other's bet or folds. Alternatively, system 500 can limit the number of possible raises. That is P1 and P2 are limited in the number of times each can raise the other's bet.

FIG. 11 illustrates possible second round action in a game where there is a raise limit according to one embodiment of the invention. Rows 1100A, 1102A–1102B, and 1104A–1104B illustrate the action where P1A1 is a check. Rows 1100B, 1106A–1106C, 1108A–1108C and 1110A–1110C illustrate the action where P1A1 is a bet. In FIG. 10, P1 could raise after checking (see rows 1004A–1004C). However, in FIG. 11, P1 is limited to either a fold or call action (see rows 1104A–1104B). That is, check raising is not allowed. Further, P2 is not allowed to raise in P2A2. Referring to rows 1110A–1110B, P2 has the option of either folding or calling at action point P2A2. Therefore, the first round is guaranteed to end no later than at P2A2.

The available actions for P1 and P2 for the second round are illustrated in FIGS. 10 and 11. Like the first round, a player must choose an action at each action point (e.g., P1A1, P2A1, P1A2, etc.). The actions are specified based on the strategy chosen by the player.

Second Round Strategy Look-up Table Operation

As in the first round, there are a set of action sequence triggering variables that are used to determine a player's strategy for the round. Each variable has an associated value that can be examined to develop a player's second round strategy. In one embodiment, the values of the variables are pre-calculated and stored in a table. In an alternate embodiment, instead of using variable values previously generated, the values can be generated dynamically during the game thereby eliminating the need to store the values. A set of criteria is used to either generate the values at runtime or to identify the row in the table that contains the values for the variables.

Figure 12:
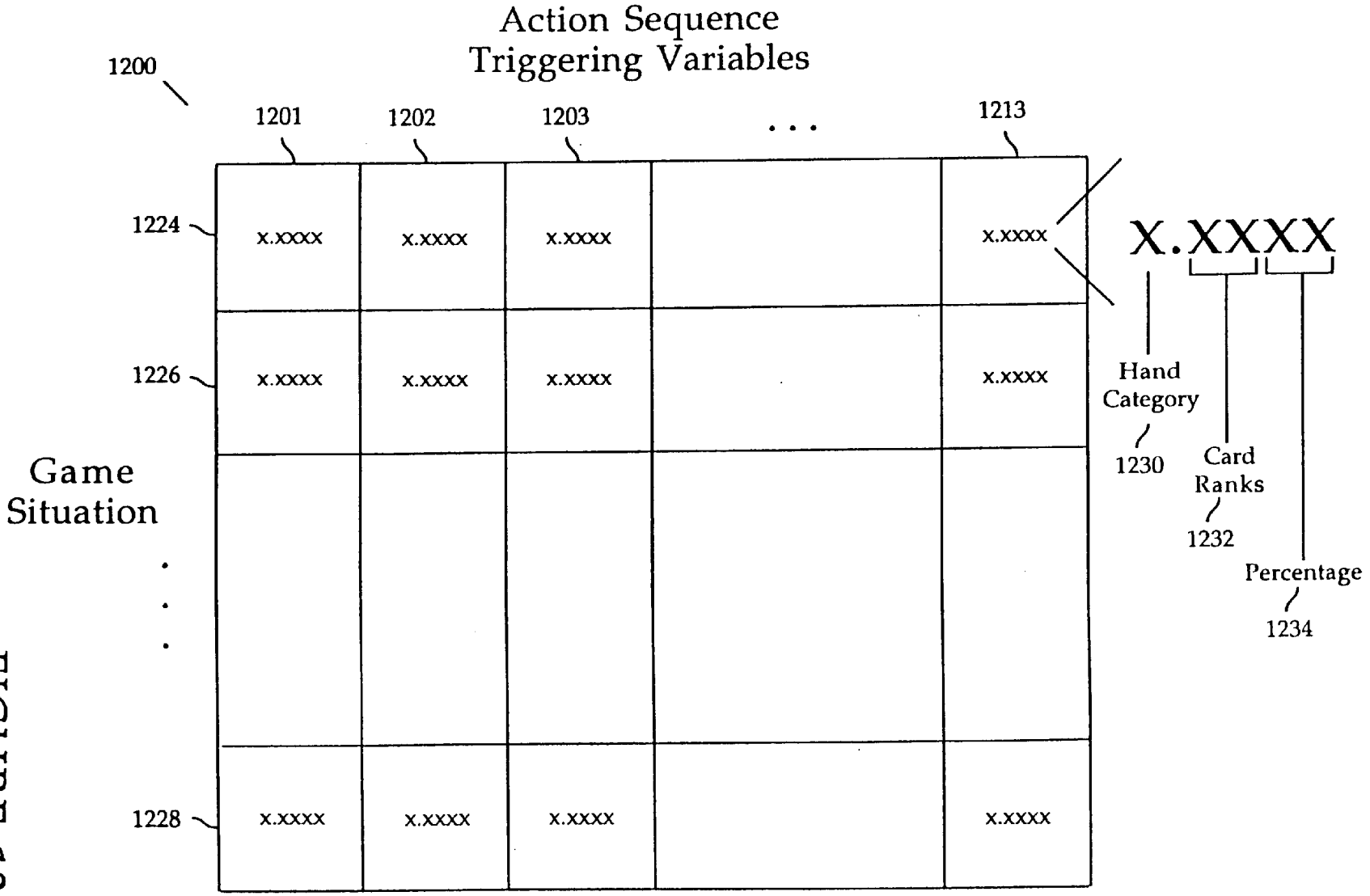
FIG. 12 provides an example of a second round strategy lookup table used in one embodiment of the invention.

An example of a second round strategy lookup table used in one embodiment of the invention is shown in FIG. 12. Table 1200 includes columns 1201–1213. Column 1201 is an extra column that contains a default value of 1 that is not used. Columns 1202–1213 of table 1200 correspond to the action sequence triggering variables used in the second round. Rows 1224–1228 represent sets of values that are assignable to the second round variables.

Each value in rows 1224–1228 uses format 1230. Format 1230 comprises hand category 1230, card rank 1232, and percentage 1234. Hand category 1230 and card rank 1232 are translated into hand ranks as follows. The integer before the decimal (i.e., hand category 1230) is a number from 0 to 8 representing one of nine hand categories as indicated in Table 11:

TABLE 11

Hand Category Codes

| Number | Category |
|---|---|
| 0 | no pairs |
| 1 | one pair |
| 2 | two pairs |
| 3 | three of a kind |
| 4 | straight |
| 5 | flush |
| 6 | full house |
| 7 | four of a kind |
| 8 | straight flush |

The first two digits to the right of the decimal point (i.e., card rank 1232) are numbers from 02 to 14 corresponding to card ranks from deuces (twos) to aces as shown in Table 12:

TABLE 12

Card Rank Codes

| Number | Category |
|---|---|
| 02 | deuce |
| 03 | three |
| 04 | four |
| 05 | five |
| 06 | six |
| 07 | seven |
| 08 | eight |
| 09 | nine |
| 10 | ten |
| 11 | jack |
| 12 | queen |
| 13 | king |
| 14 | ace |

The remaining digits (i.e., percentage 1234) represent the percentage of time the particular hand specified by hand category 1230 and card rank 1232 is played according to the associated action sequence.

For example, given a value of "1.1231", the "1," according to Table 11, means a pair. The next two digits, "12," according to Table 12, corresponds to "queen." The next two digits, "31," represent 0.31 or 31% of the time. According to Table 11, if the variable having the value 1.1231 represents the lowest hand with which P1 will bet, then P1 will bet with a pair of queens 31% of the time. The remaining time, P1 will pass with a pair of queens. The percentage is relevant only if the current hand is of the exact rank specified by the variable. P1 will pass with the next lower hand (pair of jacks), and bet with the next higher hand (pair of kings).

FIG. 13 illustrates actual columns for table 1200 of FIG. 12 according to an embodiment of the invention. Table 12 describes the action sequence triggering variables identified in FIG. 13.

TABLE 13

Explanations of Columns of Figure 13

| Column | Variable Name | Definition |
|---|---|---|
| 1382 | B1 | Lowest hand with which P1 will bet legitimately. |
| 1383 | b1 | Highest hand with which P1 will bluff-bet and fold if raised. |
| 1384 | C2 | Lowest hand with which P2 calls if P1 bets. |
| 1385 | C1R | Lowest hand with which P1 will call if P2 raises. |
| 1386 | R2 | Lowest hand with which P2 raises if P1 bets. |
| 1387 | r2 | Highest hand with which P2 bluff-raises if P1 bets. |
| 1388 | C2RR | Lowest hand with which P2 calls if P1 reraises. |
| 1389 | RR1 | Lowest hand with which P1 reraises if P2 raises. |
| 1390 | rr1 | Highest hand with which P1 bluff reraises. |
| 1391 | C1 | Lowest hand with which P1 calls if P2 bets after P1 passes. |
| 1392 | B2 | Lowest hand with which P2 bets if P1 passes. |
| 1393 | b2 | Highest hand with which P2 bluff-bets if P1 passes. |

Some of the variables are used to determine P1's strategy while others are used for P2. Table 14 identifies the variables used for P1 and the actions affected by each variable.

TABLE 14

Second Round Variables for P1

| Column | Variable Name | Action 1 (P1A1) | Action 2 (P1A2) | Description |
|---|---|---|---|---|
| 1382 | B1 | bet | fold | Lowest hand with which P1 will bet legitimately. |
| 1383 | b1 | bet | fold | Highest hand with which P1 will bluff-bet and fold if raised. |
| 1385 | C1R | bet | call | Lowest hand with which P1 will call if P2 raises. |
| 1389 | RR1 | bet | reraise | Lowest hand with which P1 reraises if P2 raises. |
| 1390 | rr1 | bluff-bet | reraise | Highest hand with which P1 bluff-bets and reraises, if raised. |
| 1391 | C1 | pass | call | Lowest hand with which P1 calls if P2 bets after P1 passes. |

TABLE 15

Second Round Variables for P2

| Column | Variable Name | Action 1 (P2A1) | Action 2 (P2A2) | Description |
|---|---|---|---|---|
| 1384 | C2 | call | | Lowest hand with which P2 calls if P1 bets. |
| 1386 | R2 | raise | fold | Lowest hand with which P2 raises if P1 bets. |
| 1387 | r2 | bluff-raise | fold | Highest hand with which P2 bluff-raises if P1 bets. |
| 1388 | C2RR | raise | call | Lowest hand with which P2 calls if P1 reraises. |
| 1392 | B2 | bet | fold | Lowest hand with which P2 bets if P1 passes. |
| 1393 | b2 | bluff-bet | fold | Highest hand with which P2 bluff-bets if P1 passes. |

Referring to FIG. 13, each row of table 1200 corresponds to a particular game situation at the end of the first round/beginning of the second round in terms of the number of cards drawn by each player and the size of the pot. For each player, there are six possible number of cards drawn: 0, 1, 2, 3, 4, 5. Accordingly, there are 36 different draw variations for each pot size. In FIG. 13, table 1200 contains 72 rows, which correspond to 36 draw variations for each of two pot sizes. The first 36 rows of FIG. 13 (i.e., rows 1301–1336) correspond to a pot size of 3 (each player having anted ½ and bet 1). Rows 1337–1372 correspond to a pot size of 5 (each player having anted ½ and bet 2). For each set of 36 rows, the first row corresponds to P1 drawing 0 cards, P2 draw 0 cards. The second row corresponds to P1 drawing 0 cards, P2 draw 1 card. The third row corresponds to P1 drawing 0 cards, P2 drawing 2 cards, and so on. The general formula that determines, for each set of 36 rows, the row number that corresponds to a draw variation is:

1. Pot Size 3:
   Row Number=[(no. of cards P1 draws)(6)+(no. of cards P2 draws)+1]; and
2. Pot Size 5:
   Row Number=[(no. of cards P1 draws)(6)+(no. of cards P2 draws)+37].

For example, if P1 draws 3 cards and P2 draws 5 cards, the corresponding row number within a set of 36 rows is:

$$[(3)(6)+(5)+1]=\text{Row } 24$$

Accordingly, if the pot is three after the first round, for a game in which P1 draws 3 cards and P2 draws 5 cards, the row that applies is row 24 of the table 1200. If the pot is five, the row that applies is row 60 (24+36).

To use table 1200, a determination is made as to which game situation (number of cards drawn by each player and size of pot) applies. The appropriate row number is identified, and the variable values corresponding to P1 or P2 as appropriate are extracted from columns 1382–1393 of that row. The values of the variables can be used to identify action sequence intervals. The current hand is compared to the hands indicated by the variable values, and a determination is made as to the location of the current hand with respect to action sequence intervals defined by the variables. The indicated action sequence is then followed.

Figure 14:
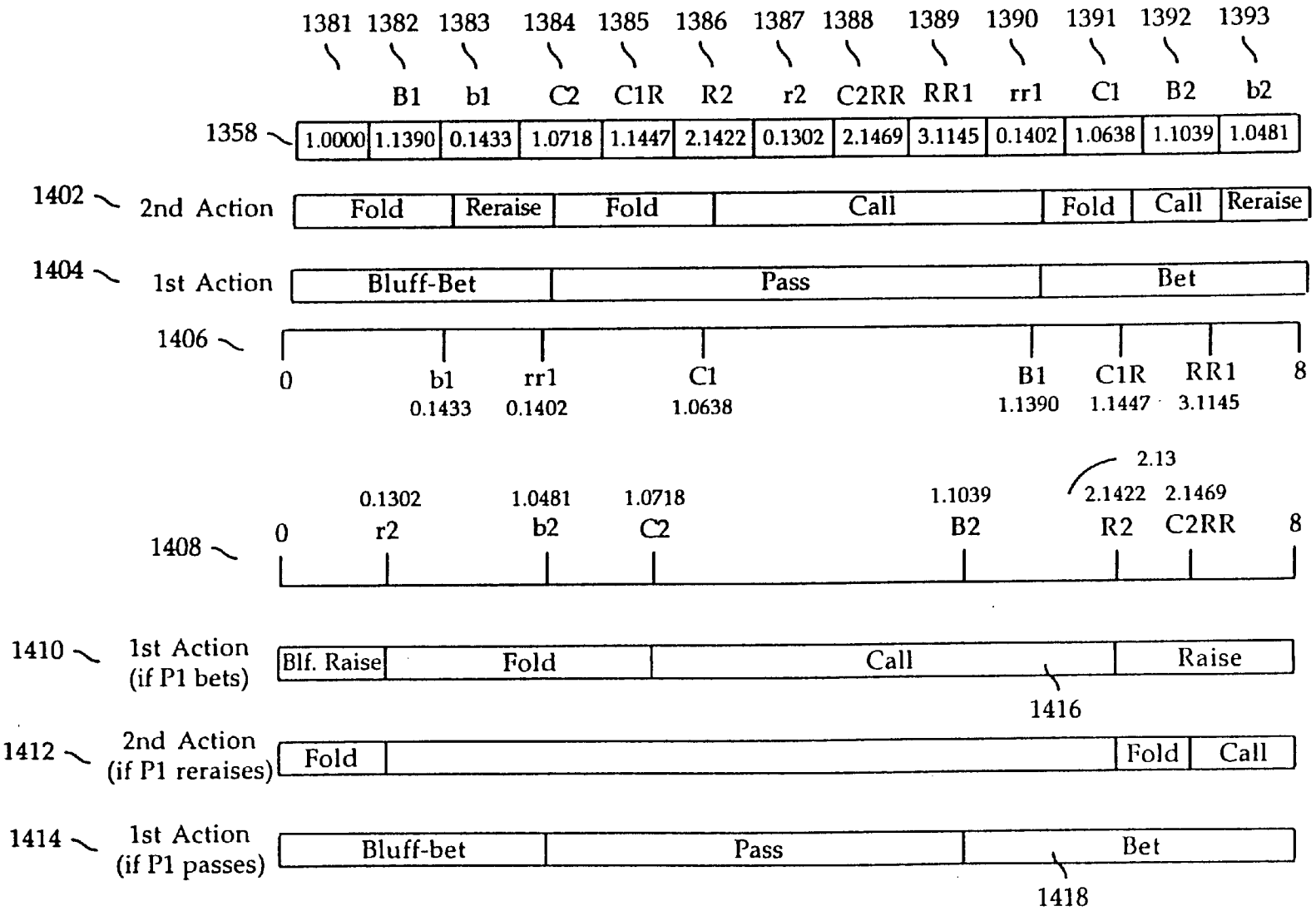
FIG. 14 illustrates the action sequence intervals given sample values for the action sequence triggering variables according to one embodiment of the invention.

FIG. 14 illustrates the action sequence intervals given sample values for the action sequence triggering variables according to one embodiment of the invention. Row 1358 of table 1200 (see FIG. 16B) is illustrated having values in columns 1382–1393 for the action sequence triggering variables. Row 1358 corresponds to the row of table 1200 that is used when both P1 and P2 drew three cards in the first round, and the pot is equal to 5. In this example, P2 is the simulated player and P2's hand after the draw is two pair with a pair of kings being the highest pair. P2's hand thus has a value, using the format 1230 of Tables 11, 12 and 13, of "2.13" (2=two pairs, 13=kings). The applicable row of the table of 1200 is [(3)(6)+3+1+36]=58 (i.e., row 1358).

In FIG. 14, the values in columns 1382–1393 and their associated variables are aligned along hand strength axes 1406 (P1 variables) and 1408 (P2 variables). The corresponding action choices are indicated by bars 1402, 1404, 1410, 1412, and 1414.

A player's hand is translated into a value that specifies hand category 1230 and card rank 1232 using Tables 11, 12, and 13. The value is placed along the player's hand strength axis (e.g., axes 1406 or 1408). For P1, the position of the value along a hand strength axis is used as a reference to the action choices 1402 for P1A2 and action choices 1404 for P1A1. Similarly, the position of P2's hand value along axis 1408 is used as a reference to the action choices 1410 and 1414 for P2A1 and action choices 1412 for P2A2.

For example, the values for variables C2, R2, r2, C2RR, B2 and b2 are used to position the variables along hand strength axis 1408. P2's hand is used to calculate a hand value of 2.13 as discussed above. Looking at hand strength axis 1408, it is found that P2's hand of 2.13 falls between B2 (1.1039) and R2 (2.1422). The action sequence indicated for P2A1 given P2's current hand, as shown in action choices 1410 and 1414, is to call if P1 bets (action choices 1410), and to bet if P1 passes (action choices 1414).

Figure 15:
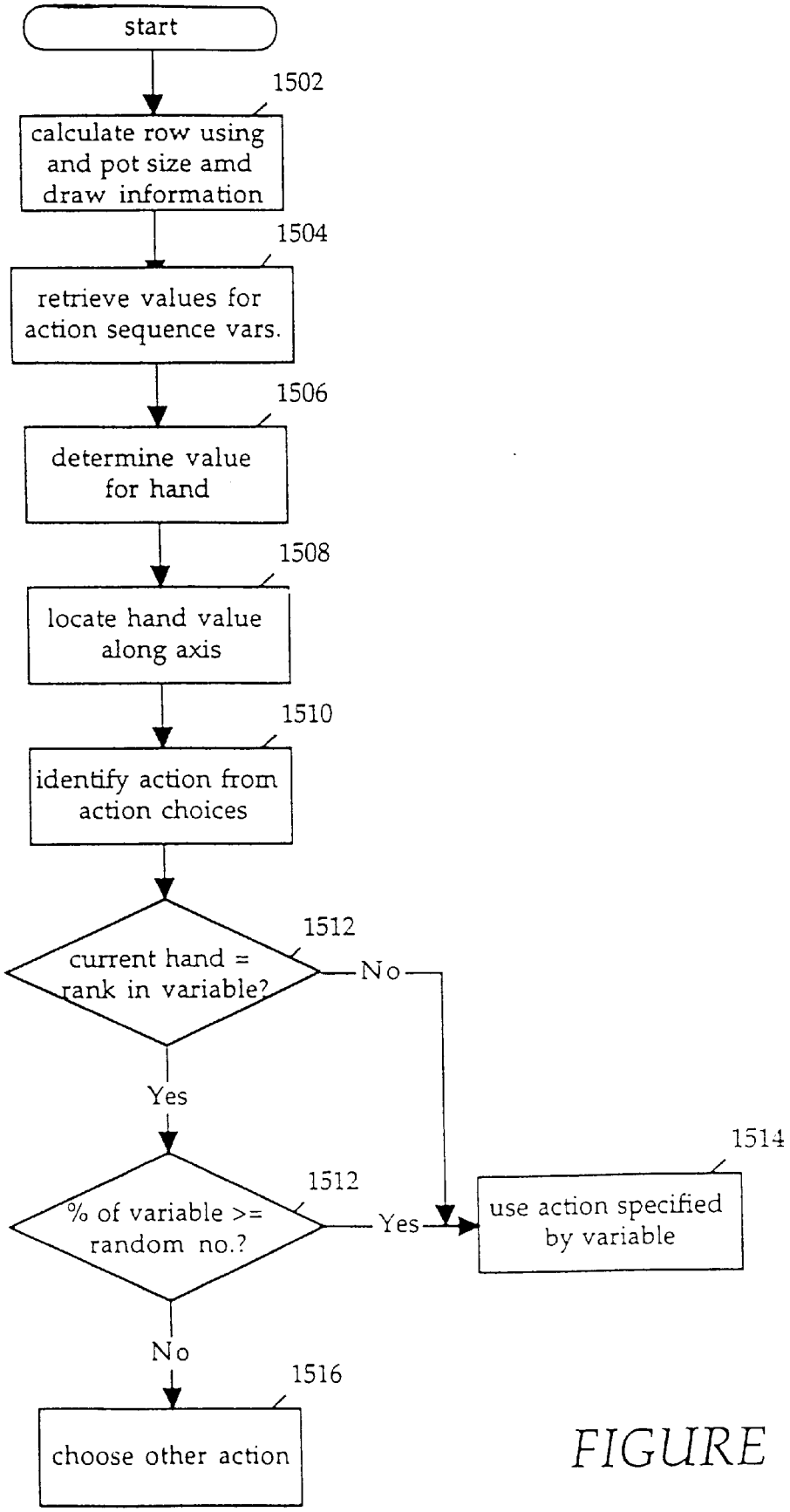
FIG. 15 provides a second round process flow that uses the table of FIGS. 12–14 according to one embodiment of the invention.

FIG. 15 provides a second round process flow that uses table 1200 of FIGS. 12–14 according to one embodiment of the invention.

At step 1502, the row of table 1200 is calculated using the pot size and draw information. At step 1504, the values for the action sequence triggering variables are retrieved for table 1200. A value is calculated for the simulated player's hand at step 1506. At step 1508, the positioning of the hand's value is determined relative to the variables positioned along the hand strength axis. At step 1510, an action is identified from the action choices.

Percentage 1234 associated with a variable is used where the player's hand is the exact rank specified for the variable. Thus, at step 1512, a determination is made at step 1512 whether the current hand is equal to the rank specified in the variable. If not, the action specified by the variable identified in step 1508 is adopted at step 1514. If so, a determination is made at step 1512 to determine whether the variable's percentage 1234 is greater than or equal to the random number. If it is, processing continues at step 1514 to use the action associated with the variable identified in step 1508. If not, processing continues at step 1516 to select the action different from the action associated with the variable specified for the next higher or lower hand than the hand specified in the variable, as appropriate. For example, in the previous example, if P2 has a pair of aces (2.14), P2 will raise if the random number is less than or equal to 0.22 (since r2=2.1422). Otherwise, P2 will call (the action indicated for the next lower hand) with its pair of aces.

FIGS. 16A–16B provide values for action sequence triggering variables for example pot sizes of 3 and 5 discussed above. FIG. 16A includes rows 1301–1336 used for a post size of 3. FIG. 16B has rows 1337–1372 for a pot size of 5.

Slot Machine Embodiments of the Invention

Figure 17:
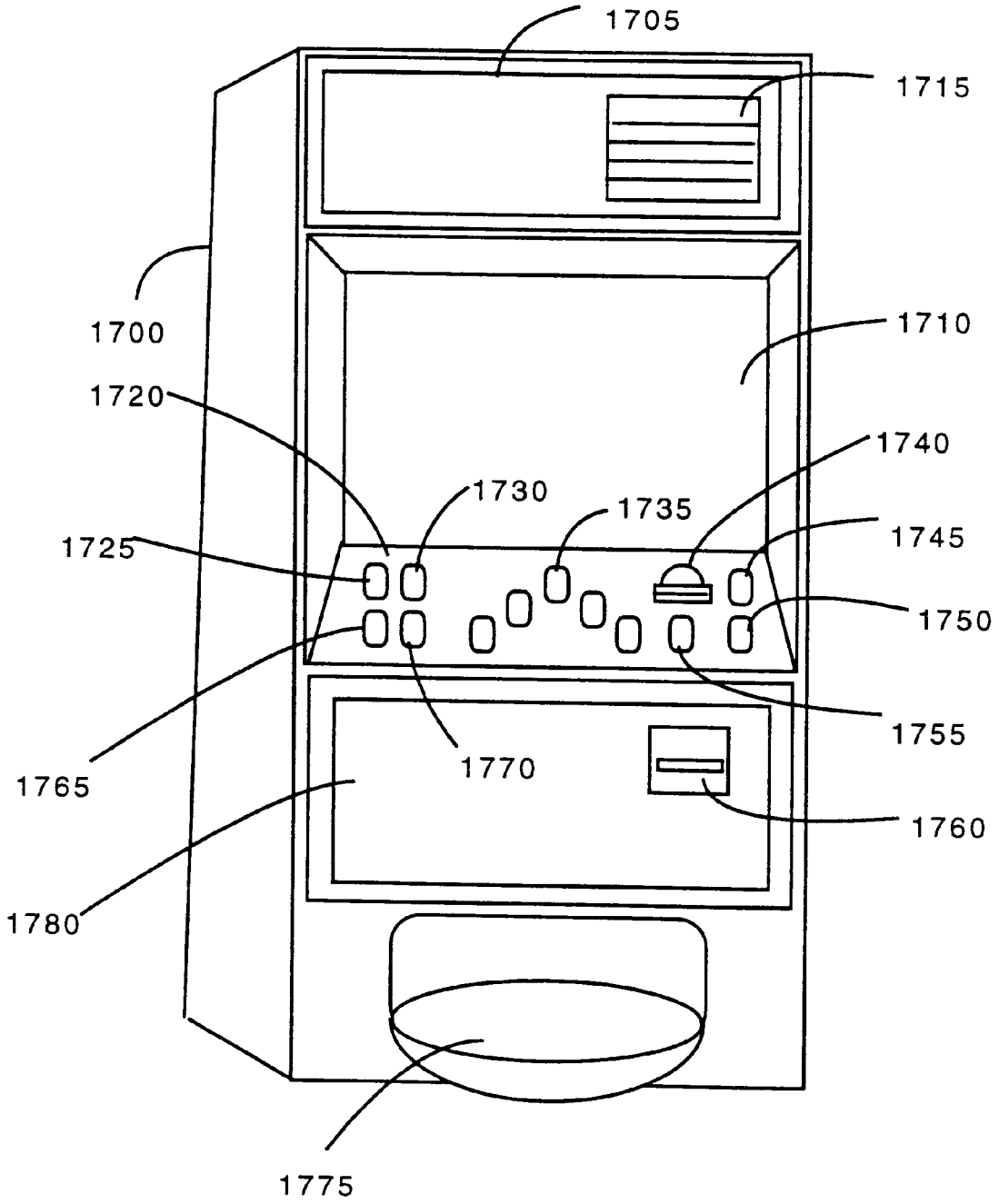
FIGS. 17 and 18 illustrate slot machine embodiments of the intelligent card playing system of the invention.
Figure 18:
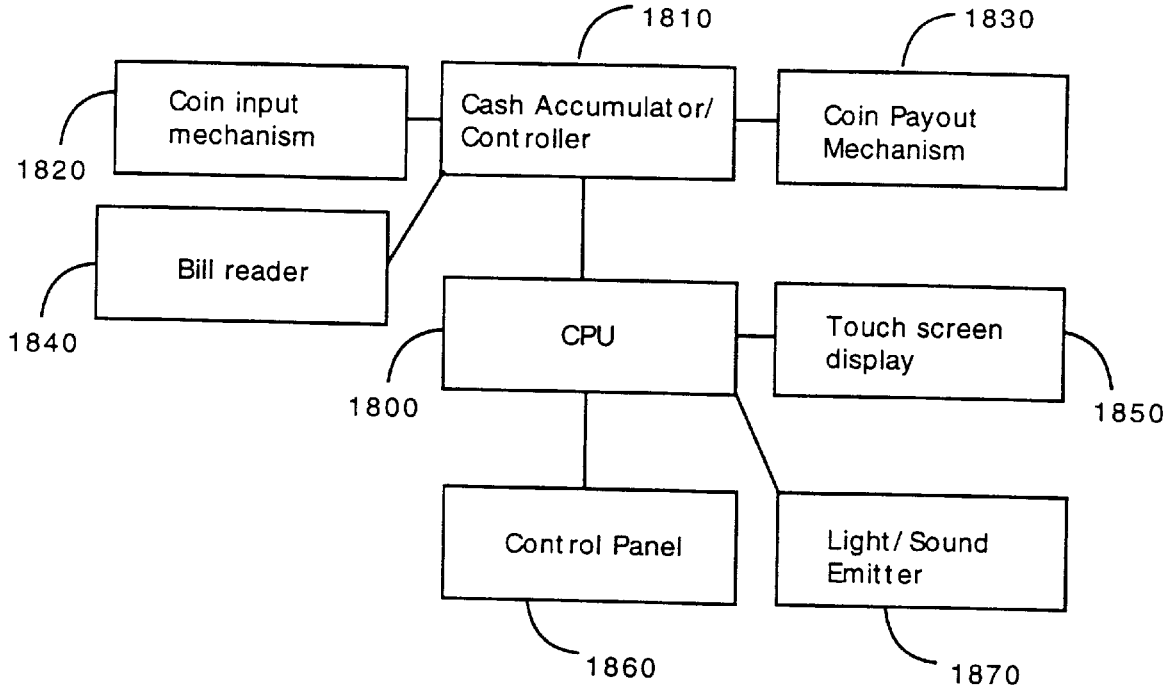

FIGS. 17 and 18 illustrate slot machine embodiments of the intelligent card playing system of the invention. It will be understood that the features shown for the embodiments of FIGS. 17 and 18 are by way of example, only. Slot machine embodiments of the invention may have any variety of other configurations, as will be apparent to those skilled in the art.

FIG. 18 is a schematic diagram illustrating the functional components in one slot machine embodiment of the invention. As shown in FIG. 18, the functional components in this embodiment include a CPU unit 1800, a cash accumulator/controller 1810, a coin input mechanism 1820, a bill reader 1840, a coin payout mechanism 1830, a control panel 1860, a touch-screen display 1850, and light and sound emitters 1870.

CPU unit 1800 contains a microprocessor such as, for example, a Pentium™ processor from Intel, along with associated software, components and peripherals, such as main memory, video graphics adapter, sound card, mass storage, and input/output interfaces, that allow CPU unit 1800 to function as an intelligent controller of the slot machine unit. CPU unit 1800 monitors user input, generates strategies for and controls actions of one or more simulated players, determines outcomes of games, and controls payout of user winnings.

Cash accumulator/controller 1810 monitors a user's cash input from coin input mechanism 1820 and bill reader 1840, and controls cash payout to a user provided by coin payout mechanism 1830, all under the control of CPU unit 1800.

Display 1850, which may, for example, be a CRT or LCD or other type of display, displays output to the user, such as, for example, images of cards dealt to a user, images of cards dealt to the simulated player(s), information concerning the state of the game, the size of the pot, the actions available to the user, etc. In the embodiment of FIG. 18, display 1850 is a touch screen display that accepts touch input from a user. In this embodiment, a user can indicate the user's desired actions by touching corresponding images displayed on the display screen. For example, the user may indicate cards to hold during a drawing phase of a game by touching the cards the user wishes to hold. Preferably, visual feedback is provided to the user to confirm that the user's touch screen input has been recognized. For example, the receipt of a touch screen input may be indicated by highlighting the image (e.g. a card selected for holding) underlying the position at which the user touches the screen.

In addition to a touch-screen, the embodiment of FIG. 18 also contains a control panel 1860 that may be used as an alternate means to provide user input. Control panel 1860 may, for example, consist of a panel containing a number of button switches. Each button corresponds to one or more user actions. A user chooses a desired action by pressing the appropriate button. In one embodiment, a user may indicate desired user actions by touching an appropriate area on touch screen 1850 and/or by pressing an appropriate button on control panel 1860.

Light/sound emitter 1870 is used to provide sound and light output. For example, light/sound emitter 1870 in one embodiment includes a flashing light and emits the sound of a bell ringing to indicate that the user has won a game.

The system of FIG. 18 may include other features found on slot machines as are known in the art.

FIG. 17 illustrates the outward appearance of one embodiment of a card playing slot machine system such as the system of FIG. 18. As shown in FIG. 17, this slot machine comprises a housing 1700 which contains functional components of the system, for example components 1800–1870 of FIG. 18. The input and output interfaces with a user are situated on the front of housing 1700. These input and output interfaces include a display screen 1710 (which may be a touch-screen display), a control panel 1720, a bill reader 1760, and a coin output tray 1775. The front of housing 1700 also includes a first and second billboard display areas 1705 and 1780, respectively.

First billboard display area 1705 comprises a backlit display containing graphics. The graphics are intended to attract players to the game, and may, for example, include the name of the game played by the slot machine system. The slot machine system may, for example, play five card draw poker. In one embodiment, the slot machine system allows a user to play a simulated poker game against an intelligent, simulated player. In another embodiment, the slot machine system allows a player to play simultaneously against an intelligent, simulated player and against a video-poker style payoff table. If the slot machine system provides combined play against a simulated opponent and a payoff table, display area 1705 may include a depiction of the payoff table 1715. Display area 1705 may also include flashing lights that are activated when a user wins a game.

Second display area 1780 provides an area in which additional graphics may be displayed. Second display area 1780 includes bill reader 1760 that is used to accept cash bills from a user.

Display 1710 is a CRT or LCD display that provides output to, and, in the case of an embodiment in which display 1710 is a touch screen display, accepts input from, a user as described with respect to display 1850 of FIG. 18.

Control panel 1720 includes a coin slot 1740 for accepting coins from a user and a number of button switches that the user may activate to indicate desired user actions. In the embodiment of FIG. 17, the buttons include a "call" button 1725, a "raise/bet" button 1730, an "ante" button 1765, a "fold/check" button 1730, five "hold" buttons 1735, a "draw" button 1745, a "cashout" button 1750, and a "game select" button 1755. Call button 1725 is activated by a user to indicate a desired call action. Raise/bet button 1730 is activated by a user to indicate a desired raise or bet action, depending on the state of the game. Ante button 1765 is activated by a user to debit the amount required for an ante from a balance of money deposited by the user into the slot machine system via coin slot 1740 or bill reader 1760, thereby initiating a new game. Fold/check button 1730 is activated by a user to indicate a desired fold or check action, depending on the state of the game. Hold buttons 1735 are used to indicate cards that the user wishes to hold prior to a draw. There is one hold button for each card in a user's hand. In the embodiment of FIG. 17, there are five hold buttons 1735, corresponding to a five-card game such as five card draw. Draw button 1745 is used by a user to initiate a draw, such that the user is dealt a new card for each card discarded (i.e. for the cards the user has indicated the user does not wish to hold). Cashout button 1750 is used by a user to obtain a payout, in cash, of any balance remaining to the user's account. The cashout amount is paid out to the user by depositing coins in payout tray 1775. Game select button 1755 is used by a user to select the desired game to play in embodiments that allow a user to select from different games. For example, in one embodiment, game select button 1755 allows a user to select optional play against a payoff table in addition to play against a simulated, intelligent opponent.

In one embodiment, the available actions available to a user an any stage of a game are indicated by lighting up only those buttons corresponding to the available actions.

Thus, a computer gaming system has been presented.

We claim:

1. A computer gaming system comprising:

a central processing unit (CPU);

a simulation engine configured to run in said central processing unit to identify a plurality of actions for at least one simulated player according to a current state of a first game, said current state of said first game including at least one prior action taken by at least one real player or said at least one simulated player;

a gaming engine coupled to said simulation engine, said gaming engine advancing a game using said plurality of actions and said at least one real player's actions and determining a first winner of said first game as between said at least one simulated player and said at least one real player; and a static evaluator coupled to said gaming engine, said static evaluator determining a second winner independently of determining said first winner as between said at least one real player and a predetermined criteria.

2. The system of claim 1 wherein said plurality of actions are associated with at least one action sequence triggering variable selected from a set of action sequence triggering variables based on selection criteria including a probability of winning said game given said current state of said game.

3. The system of claim 1 wherein said gaming engine advances said game by executing said plurality of actions at corresponding action points in said game, and wherein said gaming engine determines said first winner as between said at least one real player and said at least one simulated player at a termination point of said game.

4. The system of claim 2 wherein said game is a card game and wherein said current state of said game comprises a hand strength of said at least one simulateed player.

5. The system of claim 4 wherein said plurality of actions include betting and draw actions.

6. The system of claim 4 wherein hand rankings are used as said criteria.

7. The system of claim 6 wherein said static evaluator determines said at least one real player to be said second winner when a hand ranking of said at least one real player exceed s a threshold hand ranking.

8. A poker playing slot machine comprising:

a central processing unit (CPU);

a simulation engine configured to run in said CPU to determine an action sequence for at least one simulated player of a game based on a current state of the game and a set of criteria derived from probabilities of winning given the state of the game, said action sequence associated with at least one action sequence triggering variable selected from a set of action sequence triggering variables; said current state of said game including a hand strength of said at least one simulated player and at least one prior action taken by said at least one real player or said at least one simulated player; and a gaming engine coupled to said simulation engine configured to run in said CPU to advance play and to determine a first winner as between said at least one simulated player and at least one real player.

9. The poker playing slot machine of claim 8 further comprising an accumulator coupled to said CPU for monitoring cash input and controlling cash payments.

10. The poker playing slot machine of claim 8 further comprising a static evaluator coupled to said gaming engine, said static evaluator determining a second winner independently of determining said first winner as between said at least one real player and a predetermined set of criteria.

11. The poker playing slot machine of claim 10 wherein said static evaluator determines said second winner as between said at least one real player and said predetermined set of criteria only if said at least one real player does not fold.

12. The poker player slot machine of claim 8 wherein said current state of the game includes the size of a pot.

13. The poker player slot machine of claim 8 wherein said current state of the game includes an identity of a first player to act.

14. The poker playing slot machine of claim 8 wherein said action sequence comprises at least one betting action selected from an action set that includes bet, fold, check, and raise actions, and at least one drawing action that identifies a number of cards to draw.

15. The poker playing slot machine of claim 8 further comprising:

a touchscreen display coupled to said gaming engine for displaying game output and accepting touch input.

16. The poker playing slot machine of claim 8 further comprising:

a control panel coupled to said gaming engine having buttons for accepting user actions.

17. A method of game playing using a computer system comprising the steps of:

determining a set of actions for at least one simulated player playing against at least one real player;

administering a first contest between said at least one real player and said at least one simulated player to determine a first winner as between said at least one real player and said at least one simulated player, said at least one simulated player playing a plurality of actions from said set of actions during said first contest; and administering a second contest independently of said first contest between said at least one real player and a predetermined set of criteria to determine a second winner as between said at least one real player and said predetermined set of criteria.

18. The method of claim 17 wherein said first and second contests are played simultaneously.

19. The method of claim 17 wherein said step of determining a set of actions for said at least one simulated player further comprises the steps of:

associating a threshold value with an action;

generating a random number;

including said action in said set of actions when said random number satisfies said threshold value; and selecting for inclusion in said set of actions another action from a set of valid remaining actions if said random number does not satisfy said threshold value.

20. The method of claim 19 wherein said threshold value represents a percentage of occurrences that a player should take said action given a current state of the game.

21. The method of claim 19 wherein said game comprises a simulated card game and said threshold value is associated with a hand strength and represents a percentage of occurrences that a player should take said action given a current state of the game including said hand strength.

22. The method of claim 17 wherein said game comprises a simulated card game and said predetermined set of criteria comprises a threshold ranking, said step of administering said second contest further comprising the steps of:

assigning a hand ranking to a hand of cards of said at least one real player; and determining said at least one real player to be the winner when said hand ranking satisfies said threshold ranking.

23. A method of playing a game using a computer system comprising the steps of:

initializing a set of action sequence triggering variables, each of said action sequence triggering variables having at least one game playing action sequence associated therewith and at least one first value associated therewith, said first value for use in selecting an action sequence triggering variable; and playing at least one round of said game between said at least one real player and at least one simulated player wherein said at least one simulated player's actions are determined using one or more of said action sequence triggering variables selected by comparing said at least one first value to at least one game state criteria value.

24. The method of claim 23 wherein said game is a card game, said step of playing further comprising the steps of:

selecting an action sequence triggering variable based on a hand strength value corresponding to a hand of cards of said at least one simulated player;

comparing a random number to said first value of said action sequence triggering variable;

choosing a first game playing action sequence associated with said action sequence triggering variable when said random number satisfies said value; and choosing a second game playing action sequence associated with said action triggering variable when said random number does not satisfy said value.

25. The method of claim 24 wherein said game is a poker game and said first game playing action sequence and said second game playing action sequence are comprised of at least one draw action and at least one betting action, said at least one betting action is selected from the set of actions including bet, raise, fold, call, and check, said at least one draw action identifying a number of cards to draw.

26. The method of claim 23 wherein a first set of action sequence triggering variables is used when said at least one simulated player is the first to take an action in said game and a second set of action sequence triggering variables is used when said at least one simulated player is the not the first to take an action in said game.

27. The method of claim 23 wherein said game is a card game, said step of playing further comprising the steps of:

generating a hand strength axis comprised of at least one action sequence interval to which a set of actions are associated, said action sequence interval having boundaries comprised of a lower boundary and an upper boundary whose values are defined by values associated with said action sequence triggering variables;

generating a hand strength value using said at least one simulated player's hand;

positioning said hand strength value along said hand strength axis;

choosing as a game playing action sequence said set of actions associated with said action sequence interval when said hand strength value falls within said boundaries of said action sequence interval;

performing the following steps when said hand strength value falls on one of said boundaries of said action sequence interval:

comparing a random number to a percentage value associated with said one of said boundaries;

choosing as said game playing action sequence said set of actions associated with said action sequence interval when said percentage value is greater than said random number; and choosing as said game playing action sequence another set of actions when said percentage value is less than said random number.

28. The method of claim 27 wherein said step of generating a hand strength value comprises the steps of:

generating a hand category value based on said at least one simulated player's hand; and generating a card rank based on said at least one simulated player's hand.

29. The method of claim 23 further comprising the steps of:

generating a table that contains at least one row, said at least one row containing at least one field that contains a value associated with one of said action sequence triggering variables;

selecting one of said at least one row based on a current state of the game.

30. The method of claim 29 wherein said game is a card game and said value in said at least one field comprises a hand category value, a card rank value and a percentage value.

31. The method of claim 29 wherein the current state of the game includes a size of the pot, a number of cards drawn by said at least one real player and a number of cards drawn by said at least one simulated player.

32. An article of manufacture comprising:

a computer usable medium having computer readable program code embodied therein for game playing using a computer system comprising:

computer readable program code configured to cause a computer to determine a set of actions for at least one simulated player playing against at least one real player;

computer readable program code configured to cause a computer to administer a first contest between said at least one real player and said at least one simulated player to determine a first winner as between said at least one real player and said at least one simulated player, said at least one simulated player playing a plurality of actions from a set of actions during said first contest; and computer readable program code configured to cause a computer to administer a second contest independently of said first contest between said at least one real player and a predetermined set of criteria to determine a second winner as between said at least one real player and said predetermined criteria.

33. The article of manufacture of claim 32 wherein said first and second contests are played simultaneously.

34. The article of manufacture of claim 32 wherein said computer readable program code configured to cause a computer to determine a set of actions for said at least one simulated player further comprises:

computer readable program code configured to cause a computer to associate a threshold value with an action;

computer readable program code configured to cause a computer to generate a random number;

computer readable program code configured to cause a computer to include said action in said set of actions when said random number satisfies said threshold value; and computer readable program code configured to cause a computer to select for inclusion in said set of actions another action from a set of valid remaining actions if said random number does not satisfy said threshold value.

35. The article of manufacture of claim 34 wherein said threshold value represents a percentage of occurrences that a player should take said action given a current state of the game.

36. The article of manufacture of claim 34 wherein said game playing comprises a simulated card game and said threshold value is associated with a hand strength and represents a percentage of occurrences that a player should take said action given a current state of the game including said hand strength.

37. The article of manufacture of claim 32 wherein said game playing comprises a simulated card game and said predetermined set of criteria comprises a threshold ranking, said computer readable program code configured to cause a computer to administer said second contest further comprising:

computer readable program code configured to cause a computer to assign a hand ranking to a hand of cards of said at least one real player; and computer readable program code configured to cause a computer to determine said at least one real player to be the winner when said hand ranking satisfies said threshold ranking.

38. An article of manufacture comprising:

a computer usable medium having computer readable program code embodied therein for playing a game using a computer system comprising:

computer readable program code configured to cause a computer to initialize a set of action sequence triggering variables, each of said action sequence triggering variables having at least one game playing action sequence associated with it and at least one first value associated therewith, said first value for use in selecting an action sequence triggering variable; and computer readable program code configured to cause a computer to play at least one round of said game between at least one real player and at least one simulated player wherein said at least one simulated player's actions are determined using one or more of said action sequence triggering variables selected by comparing said at least one first value to at least one game state criteria value.

39. The article of manufacture of claim 38 wherein said game is a card game, computer readable program code configured to cause a computer to play at least one round of said game further comprises:

computer readable program code configured to cause a computer to select an action sequence triggering variable based on a hand strength value corresponding to a hand of cards of said at least one simulated player;

computer readable program code configured to cause a computer to compare a random number to said first value of said action sequence triggering variable;

computer readable program code configured to cause a computer to choose a first game playing action sequence associated with said action sequence triggering variable when said random number satisfies said value; and computer readable program code configured to cause a computer to choose a second game playing action sequence associated with said action triggering variable when said random number does not satisfy said value.

40. The article of manufacture of claim 39 wherein said game is a poker game and said first game playing action sequence and said second game playing action sequence are comprised of at least one draw action and at least one betting action, said at least one betting action is selected from the set of actions including bet, raise, fold, call, and check, said at least one draw action identifying a number of cards to draw.

41. The article of manufacture of claim 38 wherein a first set of action sequence triggering variables is used when said at least one simulated player is the first to take an action in said game and a second set of action sequence triggering variables is used when said at least one simulated player is the not the first to take an action in said game.

42. The article of manufacture of claim 38 wherein said game is a card game, said computer readable program code configured to cause a computer to play at least one round of said game further comprises:

computer readable program code configured to cause a computer to generate a hand strength axis comprised of at least one action sequence interval to which a set of actions are associated, said action sequence interval having boundaries comprised of a lower boundary and an upper boundary whose values are defined by values associated with said action sequence triggering variables;

computer readable program code configured to cause a computer to generate a hand strength value using said at least one simulated player's hand;

computer readable program code configured to cause a computer to position said hand strength value along said hand strength axis;

computer readable program code configured to cause a computer to choose as a game playing action sequence said set of actions associated with said action sequence interval when said hand strength value falls within said boundaries of said action sequence interval;

computer readable program code configured to cause a computer to choose between said set of actions associated with said action sequence interval and another set of actions when said hand strength value falls on one of said boundaries of said action sequence interval.

43. The article of manufacture of claim 42 wherein said computer readable program code configured to cause a computer to choose between said set of actions associated with said action sequence interval and another set of actions further comprises:

computer readable program code configured to cause a computer to compare a random number to a percentage value associated with said one of said boundaries;

computer readable program code configured to cause a computer to choose as said game playing action sequence said set of actions associated with said action sequence interval when said percentage value is greater than said random number; and computer readable program code configured to cause a computer to choose as said game playing action sequence another set of actions when said percentage value is less than said random number.

44. The article of manufacture of claim 42 wherein said computer readable program code configured to cause a computer to generate a hand strength value comprises:

computer readable program code configured to cause a computer to generate a hand category value based on said at least one simulated player's hand; and computer readable program code configured to cause a computer to generate a card rank based on said at least one simulated player's hand.

45. The article of manufacture of claim 38 further comprising:

computer readable program code configured to cause a computer to generate a table that contains at least one row, said at least one row containing at least one field that contains a value associated with one of said action sequence triggering variables;

computer readable program code configured to cause a computer to select one of said at least one row based on a current state of the game.

46. The article of manufacture of claim 45 wherein said game is a card game and said value in said at least one field comprises a hand category value, a card rank value and a percentage value.

47. The article of manufacture of claim 45 wherein the current state of the game includes a size of the pot, a number of cards drawn by said at least one real player and a number of cards drawn by said at least one simulated player.

* * * * *